US007393087B2

(12) United States Patent
Iijima et al.

(10) Patent No.: US 7,393,087 B2
(45) Date of Patent: Jul. 1, 2008

(54) INK SUPPLY STRUCTURE WITH TRANSPORT TUBE

(75) Inventors: Shota Iijima, Nagoya (JP); Shingo Ito, Kazugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 337 days.

(21) Appl. No.: 11/073,946

(22) Filed: Mar. 8, 2005

(65) Prior Publication Data

US 2005/0195253 A1 Sep. 8, 2005

(30) Foreign Application Priority Data

Mar. 8, 2004 (JP) ..... P2004-064325

(51) Int. Cl.
*B41J 2/17* (2006.01)
*B41J 2/175* (2006.01)

(52) U.S. Cl. ..... 347/84; 347/85

(58) Field of Classification Search ..... 347/84, 347/85, 86, 50
See application file for complete search history.

(56) References Cited

U.S. PATENT DOCUMENTS

| | | | | |
|---|---|---|---|---|
| 6,378,971 | B1 | 4/2002 | Tamura et al. | |
| 6,582,068 | B2 | 6/2003 | Ishizawa et al. | |
| 6,758,556 | B2 | 7/2004 | Ishizawa et al. | |
| 6,796,627 | B2 | 9/2004 | Kimura et al. | |
| 6,834,945 | B2 | 12/2004 | Ishizawa et al. | |
| 2001/0024225 | A1 | 9/2001 | Ishizawa et al. | |
| 2002/0149646 | A1 * | 10/2002 | Pawlowski et al. | 347/50 |
| 2002/0196312 | A1 | 12/2002 | Ishizawa et al. | |
| 2003/0184771 | A1 | 10/2003 | Yamamoto et al. | |
| 2005/0012792 | A1 * | 1/2005 | Kumagai et al. | 347/85 |
| 2005/0146578 | A1 * | 7/2005 | Takagi et al. | 347/86 |

FOREIGN PATENT DOCUMENTS

| | | |
|---|---|---|
| EP | 1164025 | 12/2001 |
| JP | 2804684 | 7/1998 |
| JP | 2001-130020 A | 5/2001 |
| JP | 2002-19135 | 1/2002 |

OTHER PUBLICATIONS

European Search Report for EP 05251385, Completed Jun. 9, 2005.

* cited by examiner

*Primary Examiner*—Stephen D. Meier
*Assistant Examiner*—Carlos A Martinez, Jr.
(74) *Attorney, Agent, or Firm*—Banner & Witcoff, Ltd

(57) ABSTRACT

An ink supply structure for supplying ink flowing out from an ink cartridge including an ink supply port via an ink transporting tube to a recording portion, including: an ink cartridge base having; a cartridge connecting portion which makes the ink flowing out from the ink cartridge, when the cartridge connecting portion connects to the ink supply port upon loading of the ink cartridge on the ink cartridge base; an ink flow path which connects to the cartridge connecting portion; and a tube connecting portion connected to the ink transporting tube, wherein the ink cartridge base is configured by a base main body and a supplemental member fitted in the base main body, and wherein the ink flow path is formed on joint faces between the base main body and the supplemental member.

25 Claims, 19 Drawing Sheets

INK SUPPLY STRUCTURE WITH TRANSPORT TUBE

BACKGROUND

1. Field

Aspects of the present invention relate to a multi-function device, printer and an ink supply structure for use in the multi-function device and the printer to supply ink from an ink cartridge to a recoding portion.

2. Description of the Related Art

Conventionally, known ink cartridges are separately disposed from ink jet heads. If the ink cartridge is disposed on an ink jet head, the ink printer may be required to be taller than desired to accommodate the ink cartridge. In an example of an ink-jet printer, an ink cartridge holder is disposed on a front-left side portion of the printer main body. The ink cartridge holder is opened forwardly from the opening to house the ink cartridge. Further, a rod-like ink outlet port connectable to an ink cartridge is disposed at a back-face wall of the ink cartridge holder. A tube path connecting the inkjet head and the ink outlet port is disposed on a back side of the back-face wall.

A space exclusively used for the tube path is necessary for the above-configuration. This prevents the printer's size from being reduced.

SUMMARY

According to at least one aspect of the invention, a multi-function device, printer and an ink supply structure may be provided that permits the printer to be downsized. Alternatively, the height of a printer may be reduced.

According to one aspect of the invention, an ink supply structure is provided for supplying ink flowing out from an ink cartridge including an ink supply port via an ink transporting tube to a recording portion, including: an ink cartridge base having; a cartridge connecting portion which makes the ink flow out from the ink cartridge, when the cartridge connecting portion connects to the ink supply port upon loading of the ink cartridge on the ink cartridge base; a tube connecting portion for connection to an ink transporting tube; and an ink flow path which connects the tube connecting portion to cartridge connecting portion, wherein the ink cartridge base is configured by a base main body having a mating face and a supplemental member having a mating face fitted to the mating face of the base main body, and wherein the ink flow path is formed between the mating faces of the base main body and the supplemental member.

By this configuration, the ink flowing out from the ink cartridge is transporting to an ink transporting tube via a cartridge connecting portion, an ink flow path and a tube connecting portion. Thus, the ink flow path is disposed between the cartridge connecting portion and the ink transporting tube, so that an extracting direction of the ink transporting tube can be arbitrarily set. The ink transporting tube can be arranged from a portion except for a back face of the cartridge base, so that the size is minimized. Because the ink flow path can be formed only by fitting mating faces of the base main body and the supplemental member, its structure can be simplified.

According to another aspect of the invention, the cartridge connecting portion is formed in a tubular shape to be inserted into the ink supply port. The cartridge connecting portion may be integrally formed with the base main body.

By this configuration, the base main body is integrally formed with the cartridge connection portion or the tube connecting portion. Thus, the number of parts can be decreased when compared with a case that provides separate parts.

According to another aspect of the invention, the tube connecting portion is formed in a tubular shape so that the ink transporting tube is externally fitted thereto. The tube connecting portion is integrally formed with the base main body.

According to another aspect of the invention, the ink transporting tube is externally fitted to the tube connecting portion. The tube connecting portion is formed in a tubular shape to protrude along with a loading direction of the ink cartridge. The tube connecting portion is integrally formed with the base main body.

By this configuration, the base main body is integrally formed with the cartridge connection portion or the tube connecting portion. Thus, the number of parts can be decreased when compared with a case with separate parts.

According to another aspect of the invention, the supplemental member is fitted to a face of the base main body opposite to the ink cartridge.

By this configuration, usability can be improved, since interference does not occur when the supplemental member is loaded to the base main body.

According to another aspect of the invention, an ink groove, which configures the ink flow path, is formed in a face of the base main body opposed to the supplemental member. The ink groove may be covered by the supplemental member.

According to another aspect of the invention, the supplemental member is a plastic sheet which is attached to the base main body to cover the ink groove.

By this configuration, space is not consumed since the supplemental member is configured by the sheet. Further, the productivity is improved since the ink flow path is configured by a groove which is covered by the sheet.

According to another aspect of the invention, a welding rib extending along the ink groove is provided at an edge of the ink groove. The sheet is heat-welded to the welding rib.

According to another aspect of the invention, a cross section of the welding rib before welding is gradually tapered from a base end of the welding rib toward a tip end of the welding rib.

By this configuration, the ink groove is attached to the sheet by heat-welding, so that other special parts for attachment are not necessary. Further, the rib may be easily welded, since the welding rib is formed in tapered shape. Because of this shape, the bonding reliability can be enhanced.

According to another aspect of the invention, the base main body is provided with a side wall which surrounds a side of the ink cartridge when the base main body is loaded with the ink cartridge.

According to another aspect of the invention, the ink cartridge is elastically retained by an elastic locking arm which is provided on the base main body when the base main body is loaded with the ink cartridge.

By this configuration, a side wall can protect the ink cartridge. Further, when the base main body is loaded with ink cartridge, the locking arm is retained at the ink cartridge, so that the ink cartridge can be stably held.

According to another aspect of the invention, an air inlet hole for permitting air to flow into the ink cartridge in accordance with ink flow is provided with the ink cartridge. The air inlet hole is closed by a valve body when the ink cartridge is unloaded. The air connecting portion is provided on the main base body and is connected to the air inlet hole by the valve body opened upon loading of the ink cartridge. An air flow path is formed between the joint faces of the base main body and the supplemental member. One end of the air flow path is connected to the air connecting portion, and wherein the other end of the air flow path is formed into an opening open to the atmosphere.

A long path is necessary for supplying the air into the ink cartridge. However, by this configuration, the air flow path for introducing the air into the ink cartridge can be formed by the base main body and the supplemental member. Thus, when compared with a case that the air flow path is configured by separate parts, the number of parts can be decreased, thus possibly requiring less space.

According to another aspect of the invention, an air groove which configures the air flow path is formed on face of the base main body opposed to the supplemental member. The air groove is covered by the supplemental member.

By this configuration, the air flow path is configured such that the air groove is covered by the supplemental member, thus the construction can be simplified.

According to another aspect of the invention, the air flow path is bent in a meandering form.

By this configuration, the ink accommodated in the ink cartridge can slowly dry itself by bending the air flow path in a meandering form.

According to another aspect of the invention, an ink pooling portion is provided in the middle of the air flow path to accumulate the ink which backwardly flows toward the air flow path via the air inlet hole.

By this configuration, even if the ink back-flows toward the air flow path via the air inlet hole, the back-flowing ink can be held in the ink pooling portion.

According to another aspect of the invention, a plate-shaped porous ink-absorbing member is held along a side face of the ink cartridge base. The opening of the air flow path opens to contact with the ink absorbing member.

By this configuration, even though the back-flowing ink exudes from the opening via the air inlet hole and the air flow path, the exuded ink is absorbed by the ink-absorbing member. Further, the ink absorbing member is retained along a side face of the ink cartridge base, so that the attachment of the ink absorbing member can be easily performed.

According to another aspect of the invention, a supporting protrusion member operable to support the ink absorbing member in unfixed-state from the opening is provided at a peripheral edge portion of the opening in the cartridge base while the supporting protrusion member protrudes toward the ink absorbing member side.

By this configuration, the air flow is not interfered, since the ink-absorbing member does not close the opening.

According to another aspect of the invention, the ink absorbing member is disposed at an ink cartridge loading side in the base main body. A holding plate is provided between the ink absorbing member and the ink cartridge.

By this configuration, the holding plate is provided between the ink-absorbing member and the ink cartridge so that the ink absorbed by the ink-absorbing member is not adhered to the ink cartridge.

DETAILED DESCRIPTION

Hereinafter, one illustrative embodiment of the invention will be described referring to FIGS. 1-19.

Figure 1:
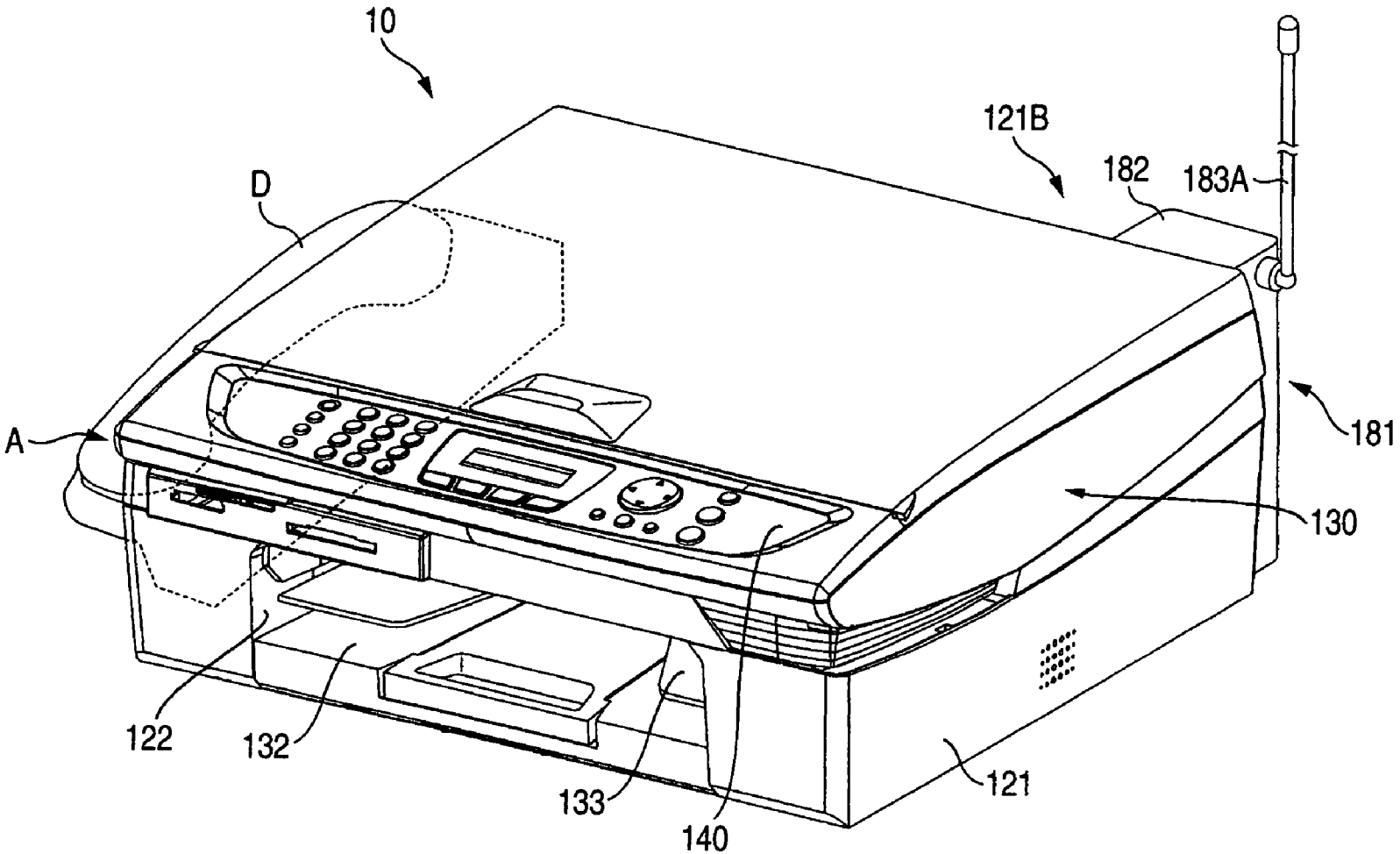
FIG. 1 is a perspective view showing a multi-function device applied to an illustrative embodiment.

FIG. 1 is a perspective view showing a multi-function device applied to this embodiment. The multi-function device 10 may include a communication function in addition to a facsimile function, and further may include a scanner function and a printer function when connected to a personal computer or the like. In the following description, the near side of FIG. 1 is set as a front side, and the right-and-left direction is defined on the basis of the orientation of FIG. 1.

The multi-function device 10 has a flat bed type scanner device 130 disposed at the upper side of a case body 121 in which various devices included in a printer are accommodated. Operating keys and a touch panel are provided at the front side of the scanner device 130, and also an operation panel 140 for carrying out an input operation of a telephone number, etc. is disposed.

Figure 2:
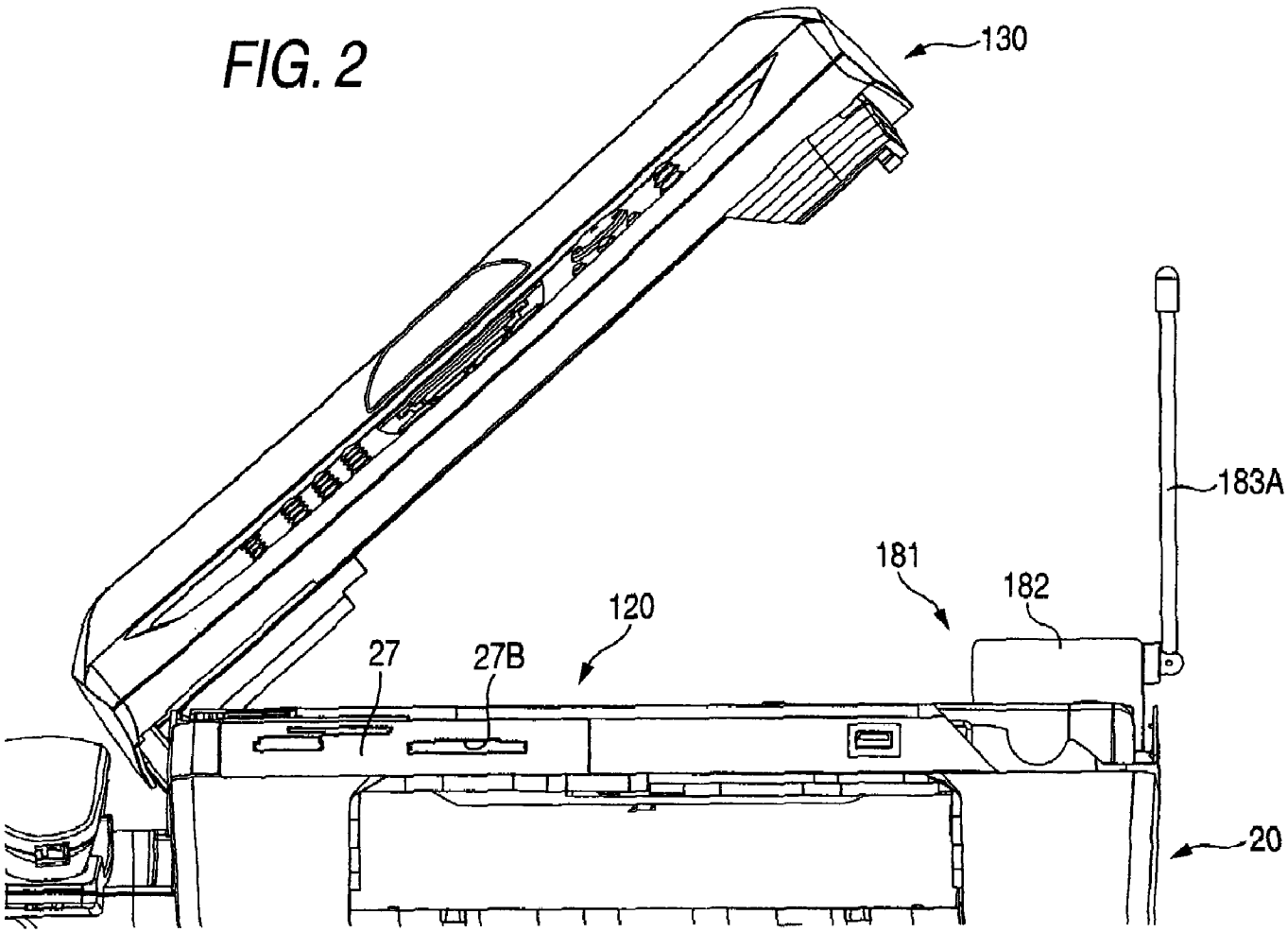
FIG. 2 is a front view showing a state where a scanner device is opened.
Figure 3:
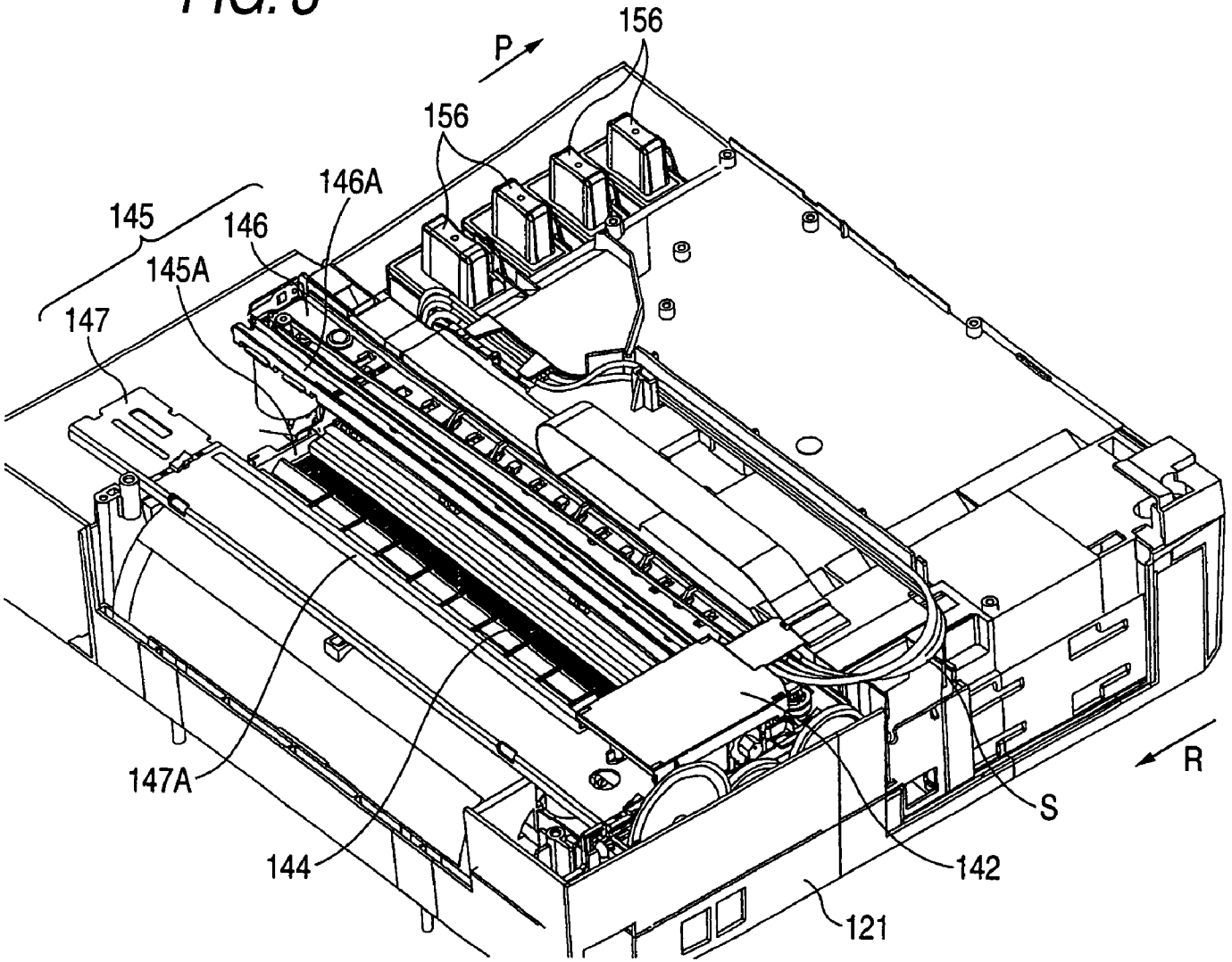
FIG. 3 is a perspective view taken from the rear side of a printer device.

The scanner device 130 is connected to the case body 121 through a hinge 124 which is provided at the side edge of the upper surface of the case body 121 (the left side edge of FIG. 2), and it is designed so as to be opened sideways around the hinge 124 as shown in FIG. 2 from the state that it is stacked on the upper portion of the case body 121 as shown in FIG. 1. A holding member (not shown) is provided to the case body 121. The holding member is engagedly fitted to the bottom surface of the scanner device 130 so as to keep the scanner device 130 to a sideways-opened state.

A receiver body (hereinafter referred to as "master phone") D is provided at the outer surface side of a side wall (left side in FIG. 2) of the case body 121 to enable telephone call. By disposing the master phone D at the left side of the case body 121 as described above, for example when a jammed recording sheet is removed or an ink cartridge is exchanged, it is possible for a user to carry out the removing or exchanging work with his/her right hand while holding the master phone D by his/her left hand. This way, the user may receive an instruction on the removing or exchanging method over the telephone. In this embodiment, the master phone D is mounted at the highest possible position under the condition that it does not interfere with the scanner device 130 when the scanner device 130 is set to the sideways-opened state. That is, a gap is kept between the master phone D and the scanner device 130 even in consideration of dispersion of products, etc. The master phone D is disposed at the highest possible position of the upper side of the base body 121 in consideration of usability when the master phone D is used.

A communication unit 181 is mounted in a vertical position at the right side edge portion of the rear portion of the case body 121 as shown in FIG. 1. The communication unit 181 has a casing 182 formed of synthetic resin, and the communication board 183 is accommodated in the casing 182. This communication board 183 is used to wirelessly connect the communication unit 181 to another transceiver (hereinafter referred to as a slave phone), and has an antenna 183A for transmission/reception.

As described above, the multi-function device 10 is provided with the directly connected master phone D and the cordless slave phone. Both the receivers (master phone, slave phone) are selectively usable in accordance with an application. Furthermore, the communications can be carried out between both the receivers. As described in detail later, a main board 161 for electrically controlling the driving of each device is provided at a corner portion 121A out of the corner portions of the case body 121, the corner portion 121A being located at the opposite corner to a corner portion 121B at which the communication board 183 is disposed. As described above, the main board 161 and the communication board 183 are disposed so as to be away from each other so that noise is prevented from being applied to the main board 161.

Next, the print device 120 will be described.

The printer device 120 of this embodiment is an ink jet type. The printing device generally includes a recording unit 21 for recording an image on a recording sheet, a supply unit 31 for supplying a recording sheet to the recording unit 121 and a main board 161.

First, the supply unit 131 will be described. As shown in FIG. 1, a tray accommodating unit 122 penetrating in the front-and-rear direction is provided at the center lower portion of the case body. A supply tray 132 is engagedly fitted in the tray accommodating unit 122 so as to be detachable from the front side. The supply tray 132 is formed of synthetic resin and designed like a plate. An arch-shaped guide piece 133 is provided from both the right and left edge portions so as to cover the upper side of the recording sheet set on the tray. The guide piece 133 has a function of positioning the recording sheet in the right-and-left direction and a function as a discharge tray (described later).

Under the mount state, the supply tray 132 is wholly accommodated in the tray accommodating unit 122, and the tip position of the supply tray 132 is substantially coincident with the front end position of the tray accommodating unit 122. Furthermore, under this state, a gap is provided between the upper surface portion of the guide piece 133 and the ceiling wall 122A of the tray accommodating unit 122 (see FIG. 4).

Figure 4:
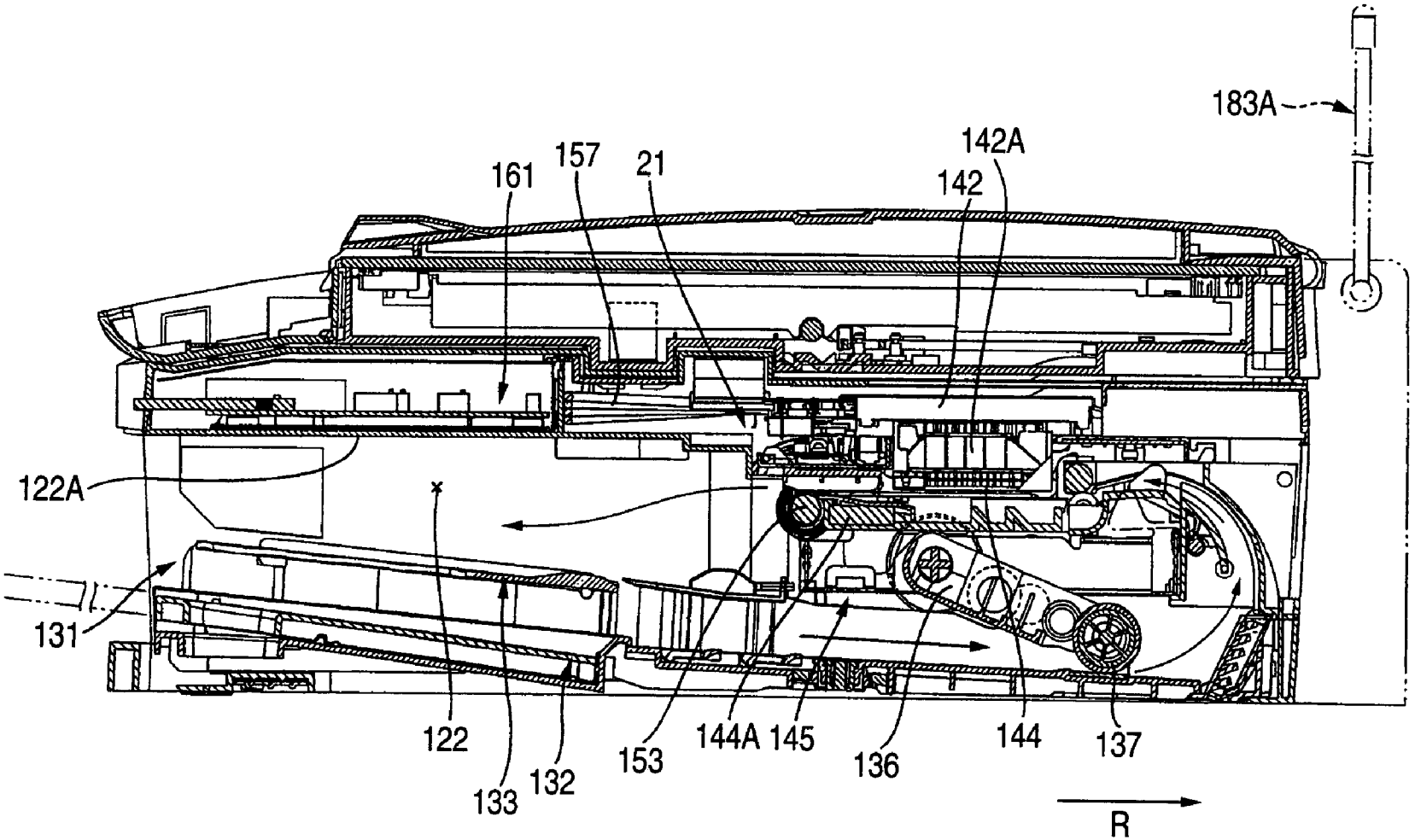
FIG. 4 is a vertically cross-sectional view of the multi-function device.

As shown in FIG. 4, an arcuate plate 35 for U-turn is mounted at the innermost surface side of the tray accommodating unit 122. A supply roller 137 is pivotably mounted on an engine frame 145 through an arm 136 so as to droop down. The supply roller 137 is connected to a motor serving as a driving motor through a link shaft (not shown), and abuts against the upper surface of the recording sheet mounted on the supply tray 132.

Therefore, when the supply roller 137 is driven through the motor, recording sheets on the supply tray 132 are fed out from the front side of the printer device 120 to the inner back side (R direction of FIG. 4) one by one. Each recording sheet thus fed out is reversed from the lower side to the upper side through the U-turn plate by 180 degrees. Thereafter, the recording sheet thus reversed is fed out to the front side, that is, to the recording unit 121 by a resist roller 38A and a driven roller 38B rotated in connection with the rotation of the resist roller 38, the resist roller 38A and the driven roller 38B being disposed at the front side of the U-turn plate 35.

The recording unit 21 mainly includes a carriage 142 having a recording head 142A, a platen 144, a timing belt 49 connected to the motor and the engine frame 145 for supporting the above elements. The engine frame 145 is disposed at the rear side of the case body 121 and at the upper side of the supply tray 132. The engine frame 145 is formed of metal, and it includes a box-shaped main body portion 145A and a pair of guide plates 146, 147 which are mounted on the upper side of the main body portion 145A so as t extend in the right-and-left direction of the case body 121. The arm 136 of the supply roller 137 is freely rotatably secured to the main body portion 145A through a shaft, and the platen 144 and waste liquid foam 144A are secured to the main body portion 145A.

The guide plates 146, 147 are formed of metal and aligned with each other in the front-and-rear direction. The carriage 142 is mounted so as to straddle over both the guide plates 146, 147 in the front-and-rear direction. Under this mount state, respective sliding projections (not shown) formed on the carriage 142 abut against the rear portion of the guide plate 146 at the front side and the front portion of the guide plate 147 at the rear side (hereinafter referred to as sliding portions 146A, 147A).

When the motor drives the timing belt 49, the respective sliding projections slide along the respective sliding portions 146A, 147A, and also the carriage 142 reciprocates along the right-and-left direction of the printer device 120. Accordingly, an image is recorded on a recording sheet by the recording head 142A when the sheet is fed through the supply unit 131 to the recording unit 21.

As shown in FIG. 4, a discharge roller 153 is provided at the front side of the engine frame 145. The discharge roller 153 is connected to the motor through interlocking means (not shown). The discharge roller 153 discharges a recording sheet having an image formed thereon onto the guide piece 133. As described above, the portion for supplying a recording sheet and the portion to which the recording sheet is discharged are vertically stacked. In addition, no dedicated discharge tray is provided. Also, the guide piece 133 serves as the discharge tray. Accordingly, the height of the overall device can be reduced. The guide piece 133 and the discharge roller 153 correspond to a discharge portion of the embodiment the present invention.

Figure 5A:
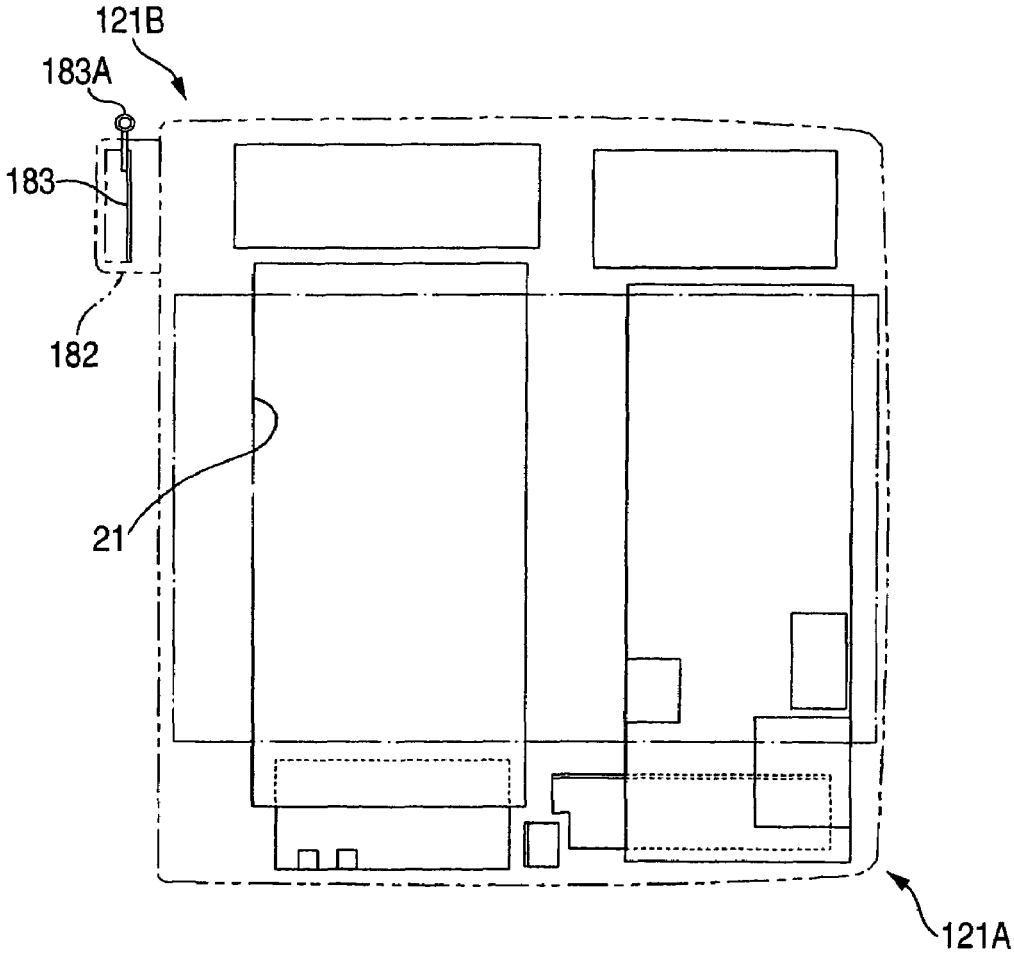
FIGS. 5A and 5B are diagram showing the arrangement of respective boards.
Figure 5B:
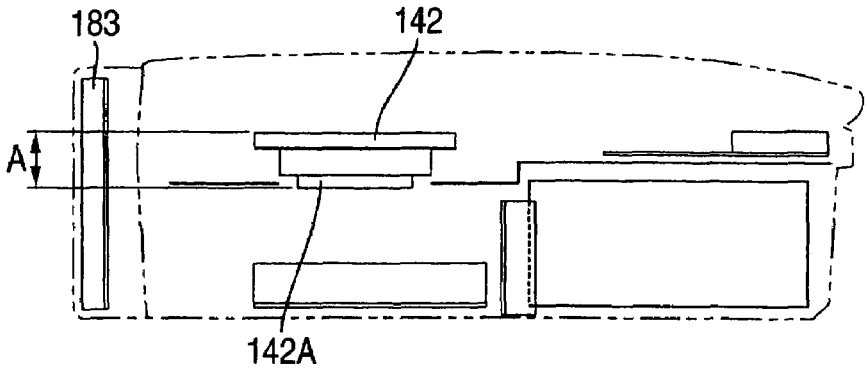

As shown in FIG. 5, a maintenance mechanism for cleaning the recording head and a cartridge holder 155 are arranged in the front-and-rear direction at the right side (the upper side in FIG. 5) of the supply tray 132. The cartridge holder 155 is designed in a box-shape opened upwardly, and ink cartridges 156 of four colors are accommodated in the cartridge holder 55. Each ink cartridge 156 and the recording head 142A are connected to each other by a liquid feeding tube 157, and when ink is jetted from the recording ink head 142A, the ink is supplied from the ink cartridge 156 to the recording head 142A. As described above, the recording head 142A and the ink cartridge 56 are disposed so as to be away from each other, whereby the height of the overall device is reduced.

Figure 6:
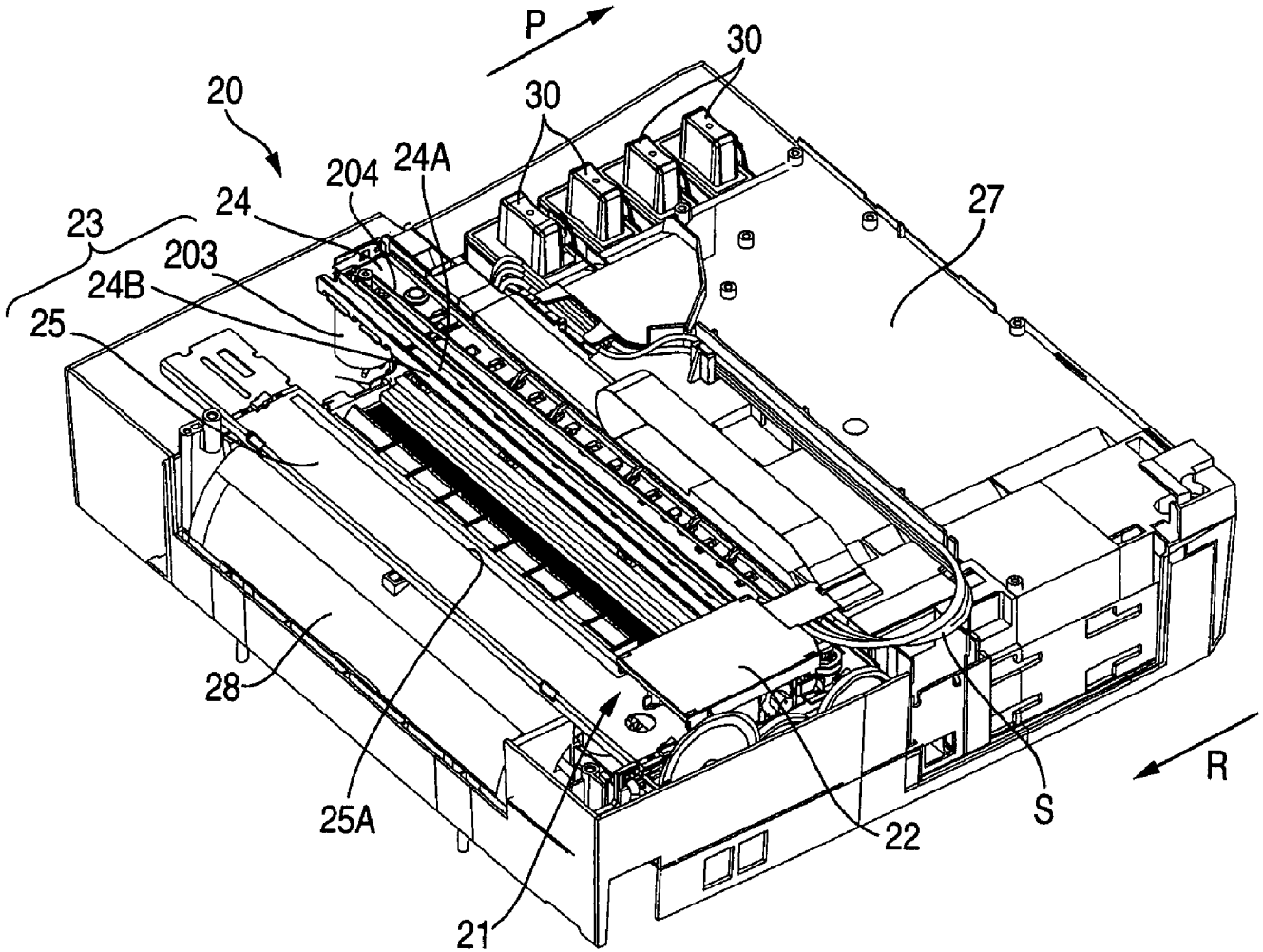
FIG. 6 is a perspective view of a recording mechanism according to the illustrative embodiment.

FIG. 6 is a perspective view showing a recording mechanism 20 from backside in a multifunction device that is applied to this embodiment. The recording mechanism 20 is an inkjet-type, having a recording unit 21 on its rear side (showed as a near side in FIG. 6). The recording unit 21 broadly includes a carriage 22 having a printing head 22*c* (functioning as a recording portion of the invention), a carriage guide 23, a carriage driving motor 203 and a timing belt 204.

The carriage guide 23 includes a pair of guide plates 24, 25 that extend in a lateral direction of the recording mechanism 20. Each of the guide plates 24 and 25 is made of metal, and is disposed along with each other at a rear portion of the recording mechanism 20 arranged in a forward and backward direction viewed by a user. The guide plate 24 has a guide portion 24B at a rear end portion thereof for guiding the carriage 22 in a direction perpendicular to a transporting direction of the recording paper. The guide portion 24B is formed by bending a part of the guide plate 24. The sliding portions 24A and 25A are provided on a frond end side of the guide plate 25 and the rear end side of the guide plate 24.

On the other hand, the carriage 22 is provided with a groove portion 22*a* that is engageable with the guide portion 24B and protrusion portions 22*b* protruding downward. (See FIG. 19) The carriage 22 is mounted so as to be bridged between both of the guide plates 24 and 25. In the mounting condition of the carriage 22, the groove portion 22*a* is slidably engaged with the guide portion 24B and lower surfaces of the protrusion portions 22*b* are brought in contact with the sliding portions 24A and 25A.

By this, the carriage 22 is positioned in a vertical direction with respect to the recording paper. When the carriage driving motor 203 is driven, the protrusion portion 22*b* slides on the sliding portions 24A and 25A while being guided by the guide portion 24B. The carriage 22 reciprocates in a direction crossing the recording paper laterally.

On the front side of the recording mechanism 20, a main control board (not shown) is disposed being covered by a metal shield case 27. On the lower side of the recording mechanism 20, a paper feeding cassette and a recording-paper transporting unit are disposed (not shown). Further, a plate 28 for making the recording paper U-turn is provided on the rear end of the recording mechanism 20. The recording-paper transporting unit functions to send the recording paper out sheet-by-sheet, from the front side of the recording mechanism 20 to the rear side of the recoding mechanism 20 (in a direction indicated by "R" direction in FIG. 6). The sent recording paper is reversed in 180 degree from the lower side to the upper side through the plate 28 for U-turning. The paper is further transported from the rear side of the recording mechanism 20 to the front side of the recoding mechanism 20 (in a direction indicated by "P" direction in FIG. 6). Further, the recording paper is printed (recorded) by the printing head 22*c* at a printing position and afterwards ejected on the paper feeding cassette (not shown).

Ink cartridges 30 (hereinafter, simply referred to as "cartridge") are disposed on the side portion of the front side of the recording mechanism 20 while being accommodated by a holder 60. The holder 60, which will be later described in detail, is provided with an ink-flow passage and an air-flow passage. The ink discharged from the cartridge 30 is supplied to the printing head 22*c* through the ink-flow passage and an ink transporting tube S. Further, the air pressure in an ink room 31 may be reduced in accordance with the discharge of the ink. In this regard, the air is introduced into the cartridge 30 via the air-flow passage so that the air pressure in the ink room 31 is maintained substantially the same as the atmosphere pressure.

Figure 8:
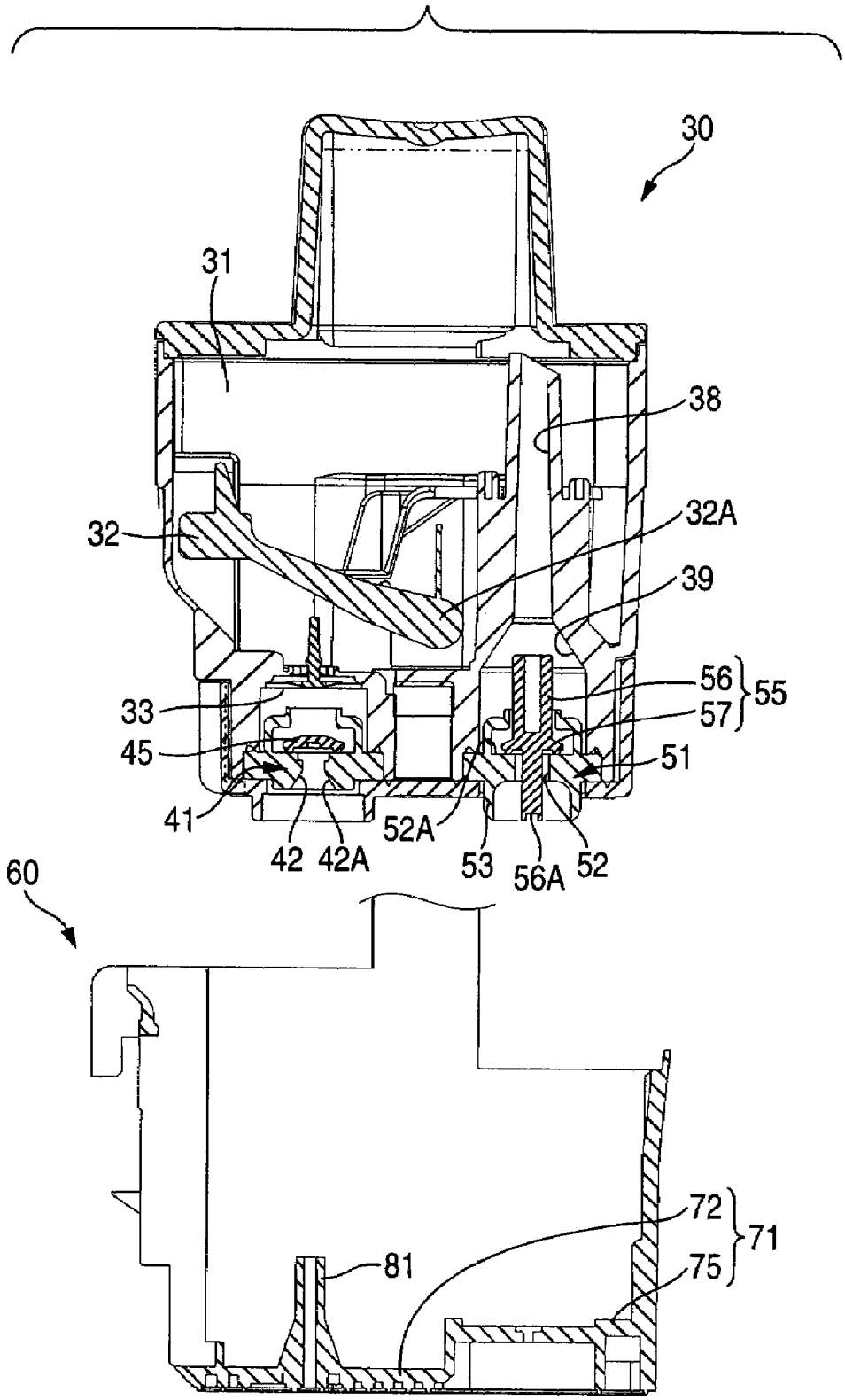
FIG. 8 is a cross sectional view showing a state before the ink cartridge is loaded in the holder.

The cartridge 30 is box-shaped and the interior of the cartridge 30 is formed as the ink room 31 in which the ink is filled. As shown in FIG. 8, a float 32 is provided in the ink room 31. The float 32 is located relative to hinge 32A so that the float 32 changes the posture thereof according to the remaining amount of the ink (the position of the liquid level of the ink). Therefore, by detecting the position of the tip end portion by a sensor (not shown) that is mounted on the holder 60, it is possible to sense the remaining amount of the ink in the cartridge 30. In addition, the position of the float shown in FIG. 8 corresponds to the condition in which the ink is empty. In the condition in which the ink is filled, the float 32 is brought into the standing posture.

In the lower portion of the cartridge 30, there is formed an ink supply port 33 communicating with the ink room 31 and an air tower 38 that is disposed at the side of the ink supply port 33. The ink supply port 33 is opened downward and accommodates therein an ink packing 41 having a first valve body 45 of the normally closed-type. The center portion of the ink packing 41 is provided with an ink outlet hole 42 that is normally closed by the first valve body 45. The ink outlet hole 42 is formed to allow a tip end portion of an ink receptive portion 81, which will be later described, to be inserted therein from below.

The air tower 38 is cylindrically formed so as to penetrate the ink room 31 in the upright direction. The upper end of the air tower 38 is formed in height so as to face with a roof wall 31A of the ink room 31. The position of the upper end of the air tower 38 is set higher than the liquid level of the ink in the initial filling condition of the ink in the ink room. Due to this, the ink filled in the ink room does not flow into the air tower 38 when the cartridge 30 is not in an inclined posture.

The lower portion of the air tower 38 is provided with an air inlet port 39. The air inlet port 39 is formed larger in inner diameter than the other portion of the air tower 38 so that the air inlet port 39 can accommodate an air packing 51 having a second valve body 55 of the normally closed type. The second valve body 55 includes a rod-like body portion 56 that penetrates an air hole 52 formed in the air packing 51 in the upright direction. The outer peripheral portion of the second valve body 55 is provided with a seal edge 57 that seals the air inlet port 39 as well as the air hole 52 by being in close contact with an upper opening surface 52A of the air hole 52.

As shown in FIG. 8, the lower end portion of the body portion 56 of the second valve body 55 is in a condition of protruding from the lower surface of the cartridge 30 at the time before the cartridge 30 is mounted on the holder 60. Further, a cylindrical lip 53 is provided on the bottom surface of the air packing 51 so as to surround the lower end portion of the second valve body 55.

Next, the holder 60 to receive the cartridge 30 will be described.

Figure 12:
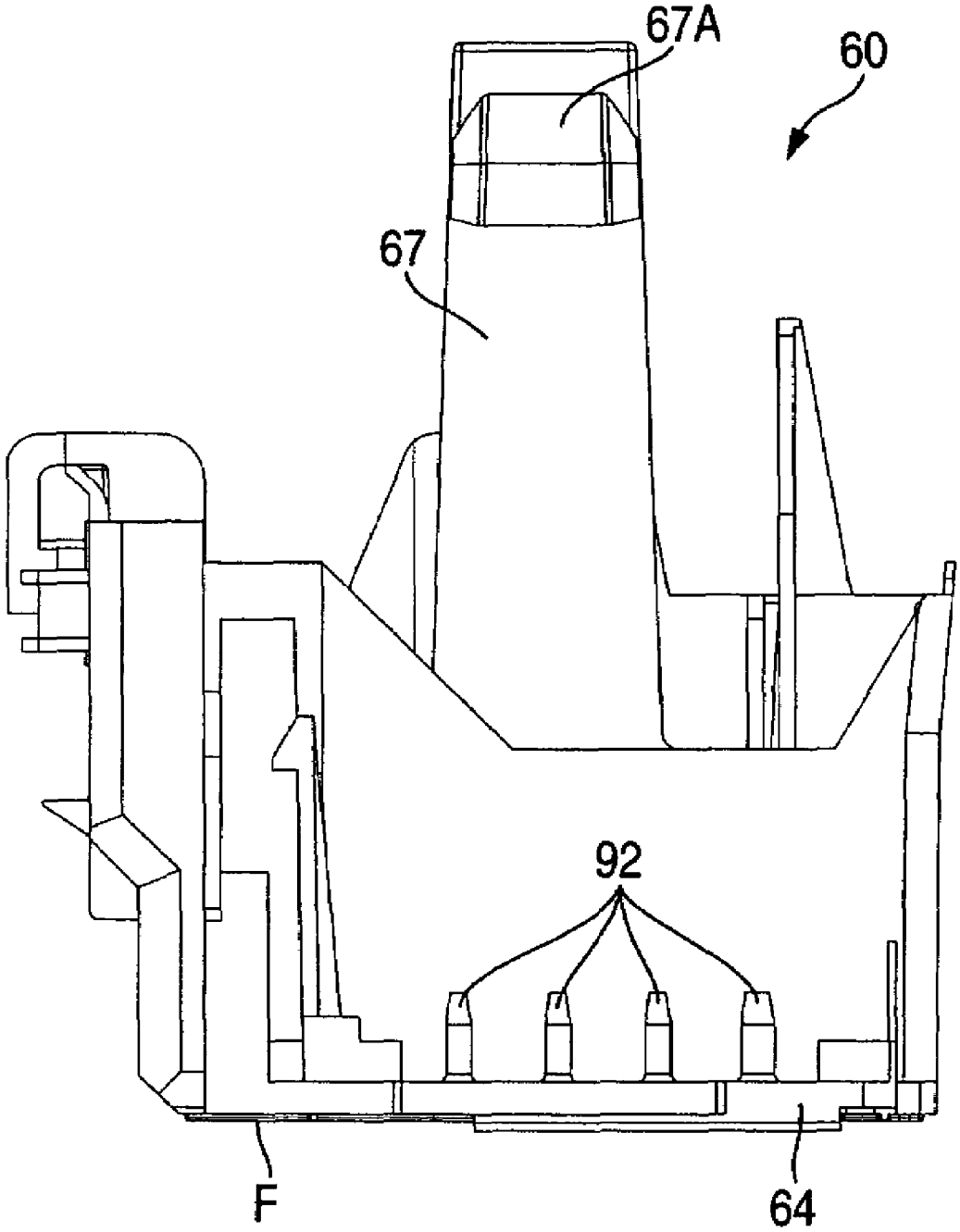
FIG. 12 is a side view of the holder.
Figure 16:
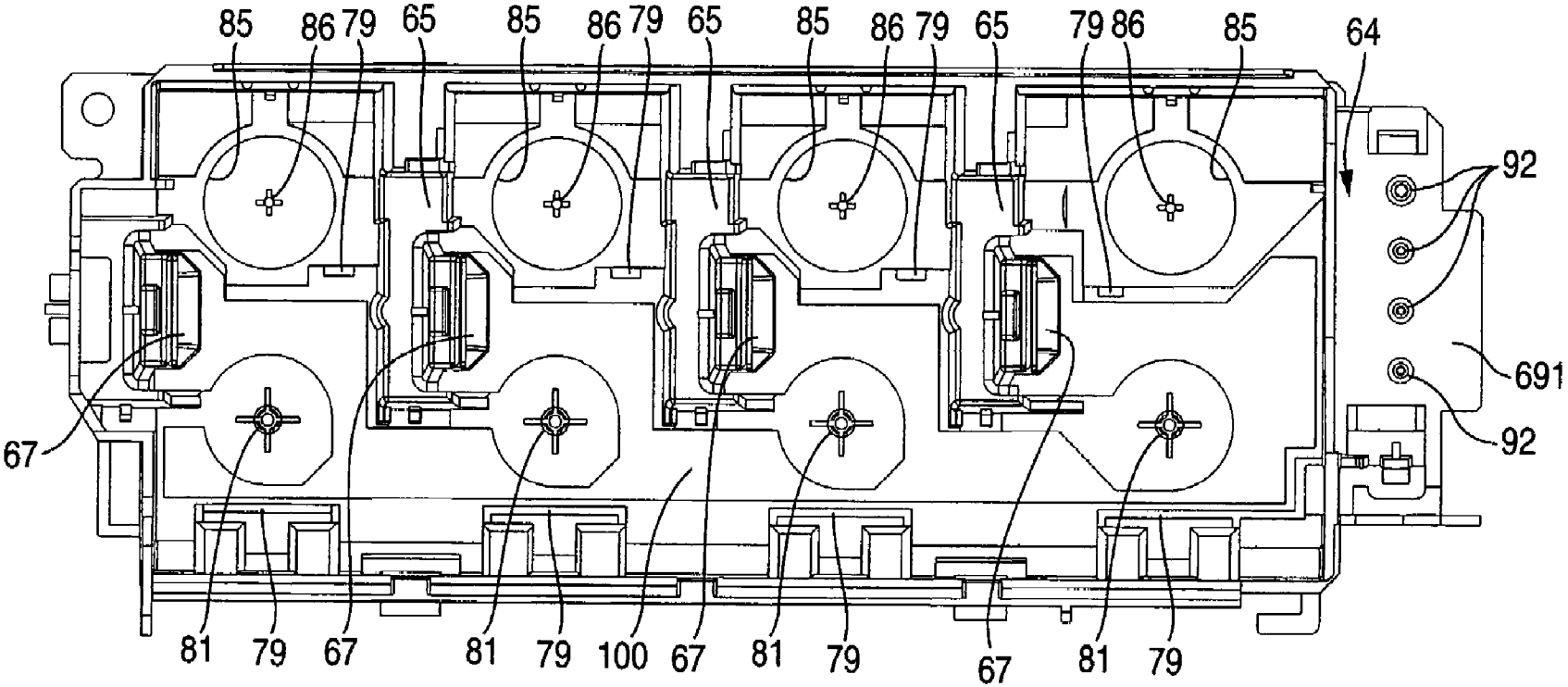
FIG. 16 is a plan view showing a state that the foam is attached to the holder.

The holder 60 has a parallel-piped shape. As shown in FIG. 12, the holder 60 includes a locking clutch 69 having a guiding portion 69*a* and a retaining rib 69*b*, on a side wall located on a front side of FIG. 12. The guiding portion 69*a* and the retaining rib 69*b* are used to fix the holder 60 to a casing on which the holder 60 is mounted. Also, as shown in FIG. 16, a right edge portion (a hang-over portion 64) of the bottom wall 71 protrudes toward a side direction. An inserting portion 691 for the casing is formed at an end portion of the hang-over portion 64.

As shown in FIG. 16, three dividing walls 65 are provided inside the holder 60. The dividing walls 65 extend straightly from the side wall 61 on one side (that is, the side wall 61 located on an upper side of FIG. 16) toward the opposite side wall 62. The dividing walls 65 partition the inside of the holder 60 into four cartridge housing rooms 68. The first to third cartridge housing rooms 68 from the left have widths substantially equal to each other. The rightmost cartridge housing room 68 has a width wider somewhat larger than those of the other cartridge housing rooms 68. Front ends of the dividing walls 65 do not reach the side wall 62. This is because foam 100 (functioning as an ink absorbing body) described later will be arranged in the vicinity of the side wall 62 so that the foam 100 straddles the cartridge housing rooms 68.

Figure 7:
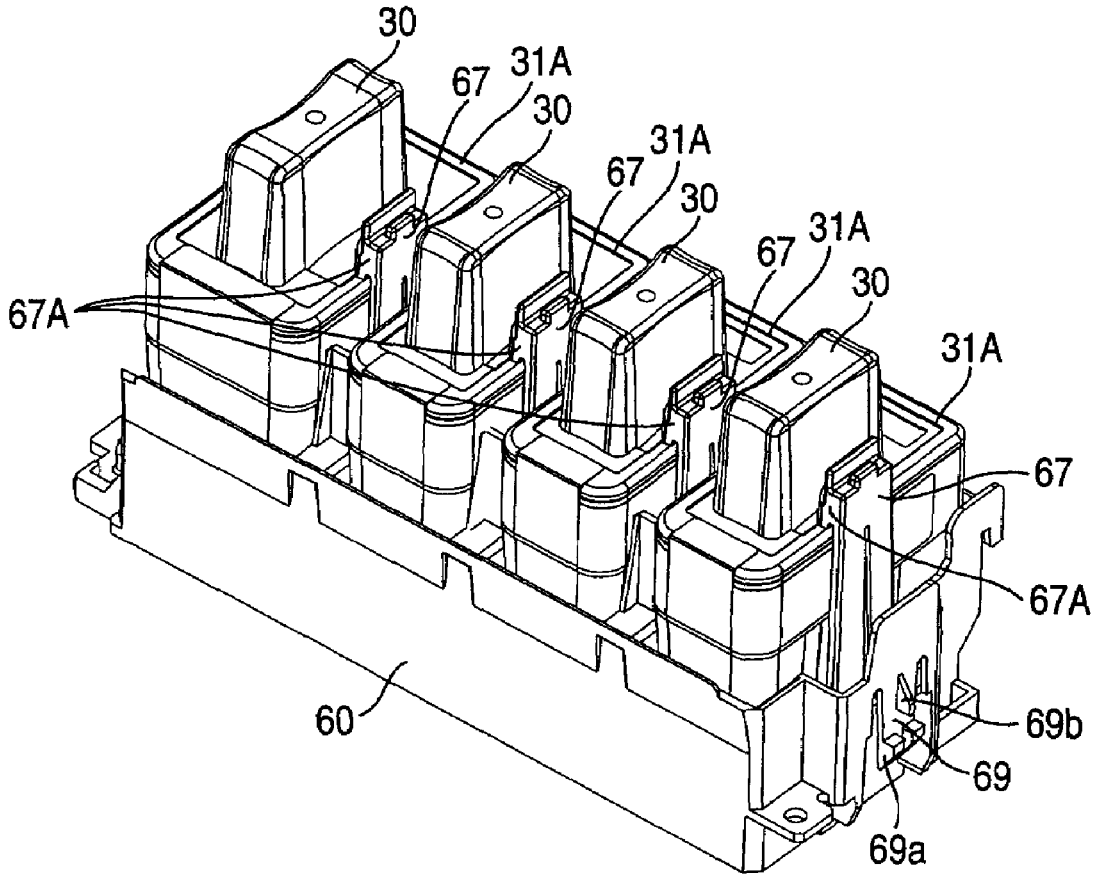
FIG. 7 is a perspective view showing an ink cartridge loaded in a holder.

Also, elastic locking arms 67 are provided on the dividing walls 65 and the left-side wall 63, respectively. As shown in FIG. 7, the elastic locking arms 67 extend toward the upper side of the drawing from an upper wall of the left-side wall 63 and upper walls of the dividing walls 65, respectively. A locking clutch 67A, which can engage with a roof wall 31A of the cartridge 30, is provided at an end portion of each elastic locking arm 67. With this configuration, each elastic locking arm 67 retains the cartridge 30 mounted on the holder 60.

Openings 71B are defined in the bottom wall 71 of the holder 60 so that each opening 71B has a shape following an outline of each locking clutch 67A. The openings 71B are defined to serve as relief holes, in consideration of an operation of opening molds when the locking clutches 67A are molded.

As shown in FIG. 8, on a side facing the air tower 38, the bottom wall 71 of each cartridge housing room 68 expands toward the upper side of the drawing (hereinafter, this portion of the bottom wall 71 is referred to as an expanding portion 75). Steps are formed between the expanding portions 75 and the other portions (hereinafter, referred to as base portions 72). The steps of the bottom walls 71 have heights substantially equal to a sum of thickness of the foam 100 disposed on the base portions 72 and thickness of a holding plate 110 disposed on the foam 100. It is noted that the bottom walls 71 function as a base main body.

Ink receptive portions 81 are integrally formed at positions facing the ink supply ports 33 of the cartridges 30 and on a side of the base portions 72 of the bottom walls 71. An outer dimension of a tip end portion of each ink receptive portion 81 is slightly larger than an inner diameter of the ink outlet hole 42. On the other hand, a guiding taper 42A is formed on a peripheral edge of each ink outlet hole 42. Therefore, when the ink receptive portions 81 are inserted into the ink packings 41 in a press fit manner, the ink receptive portions 81 move into the ink outlet holes 42.

Figure 9:
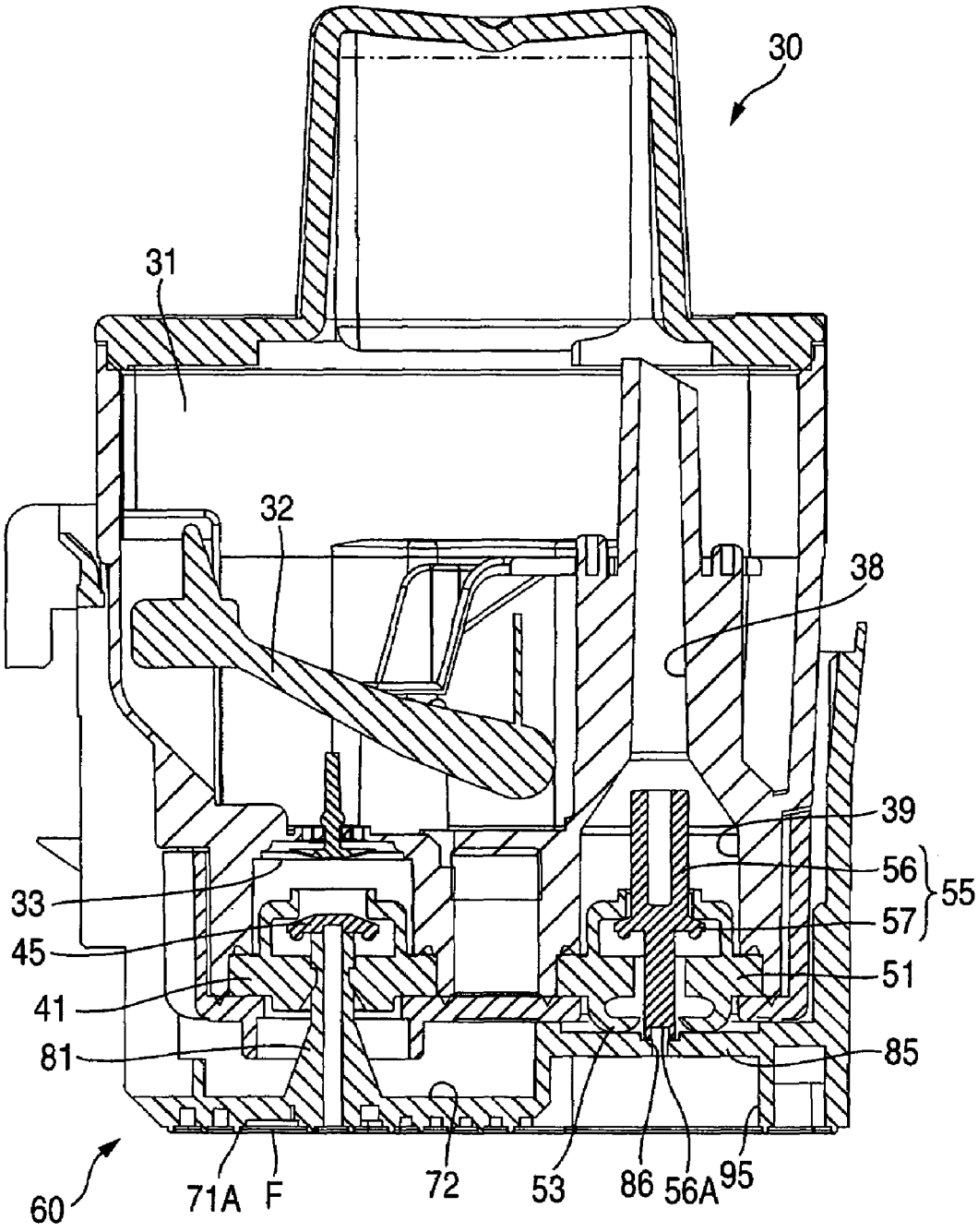
FIG. 9 is a cross sectional view showing a state that the ink cartridge is loaded in the holder.
Figure 10:
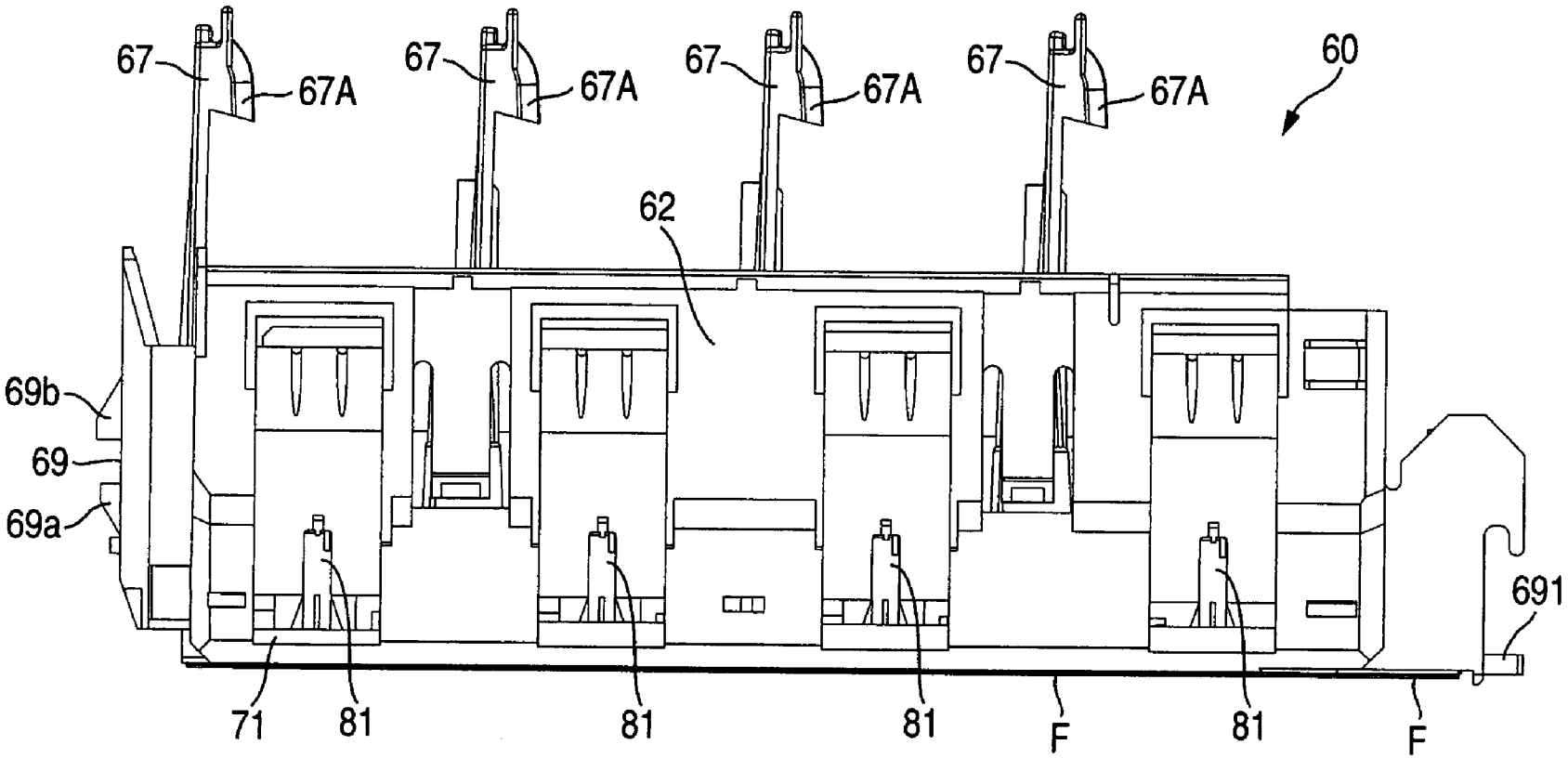
FIG. 10 is a front view of the holder.

In a state where the cartridges 30 are mounted in the cartridge housing rooms 68, the ink receptive portions 81 moving into the packings 41 press first valve bodies 45 to the upper side of the drawing to open the ink outlet holes 42 (see FIG. 9). Thereby, the ink supply ports 33 communicate with the ink receptive portions 81, and ink in the ink rooms 31 can flow into the ink receptive portions 81 through the ink supply ports 33. In this state, each ink packing 41 is in close contact with both an inner periphery of the ink supply port 33 and an outer periphery of the ink receptive portion 81 so as to create a seal therebetween.

Circular receiving face portions 85 are provided on a side of the expanding portions 75 of the bottom walls 71, at positions facing the air towers 38, respectively. The circular receiving face portions 85 function as an air connecting portion. An air inlet hole 86 is defined at a center portion of each circular receiving face portion 85. An upper portion of each air inlet hole 86 is larger in an inner diameter than a lower portion thereof. A lower end portion of a second valve body 55 abuts against the upper portion of each air inlet hole 86. Therefore, when the cartridges 30 are mounted in the cartridge housing rooms 68, the second valve bodies 55 abut against the step portions of the air inlet holes 86, thereby pressing the second valve bodies 55 upward. As a result, the second valve bodies 55 open the air holes 52.

On the other hand, a slit 56A is defined in the lower end portion of each second valve body 55. In the mounted state, the air inlet holes 86 and the slits 56A continue to each other, respectively. Therefore, air can flow from an air inlet hole 86 side through the air inlet ports 39 to the inside of the ink rooms 31. As shown in FIG. 9, in this state, a cylindrical lip 53 of each air packing 51 elastically contacts with the upper surface of the circular receiving face portion 85 while being bent inward, to seal between an inner portion of the air tower 38 and the circular receiving face portion 85. Also, in this embodiment, with regard to timings of opening the first valve body 45 and the second valve body 55, the second valve body 55 is opened slightly earlier than the first valve body 45. The reasons of this setting are as follows. When the cartridge 30 is in an unused state, a pressure of the ink room 41 is set to be lower than air pressure. Therefore, if the first valve body 45 were opened earlier than the second valve body 55 or the first valve body 45 and the second valve body 55 were opened simultaneously, ink would be absorbed from the printing head 22*c* through the ink transporting tube S, resulting in destroying meniscus formed in the nozzle portion 22*d* of the printing head 22*c*. Therefore, the second valve body 55 is opened earlier than the first valve body 45 in order to prevent the meniscus from being destroyed.

Figure 13:
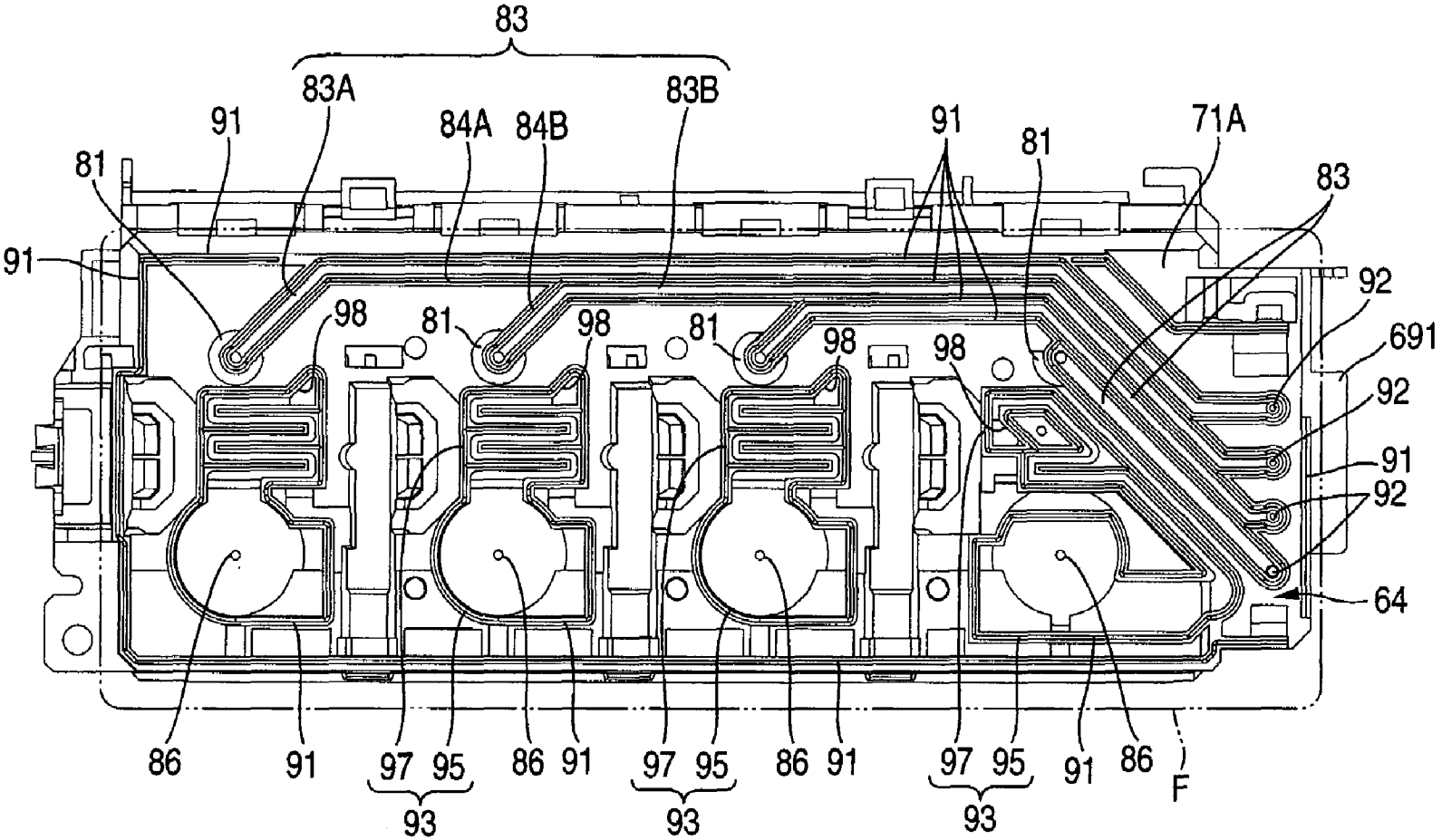
FIG. 13 is a back view of the holder.

Subsequently, ink grooves 83 communicating with the ink receptive portions 81 and air grooves 93 communicating with the air inlet holes 86 will be described with reference to FIG. 13.

The ink grooves 83 are formed (recessed) on a lower face 71A of the bottom wall 71, that is, on a face opposite to the side where the cartridge 30 is mounted, for each ink receptive portion 81.

More specifically, the ink grooves 83 obliquely extend from the ink receptive portions 81, extend sideways (right side in FIG. 13) along a side edge (upper edge in FIG. 13) of the holder 60, and then obliquely extend toward a hang-over portion 64 formed on the right side portion of the holder 60.

Figure 17:
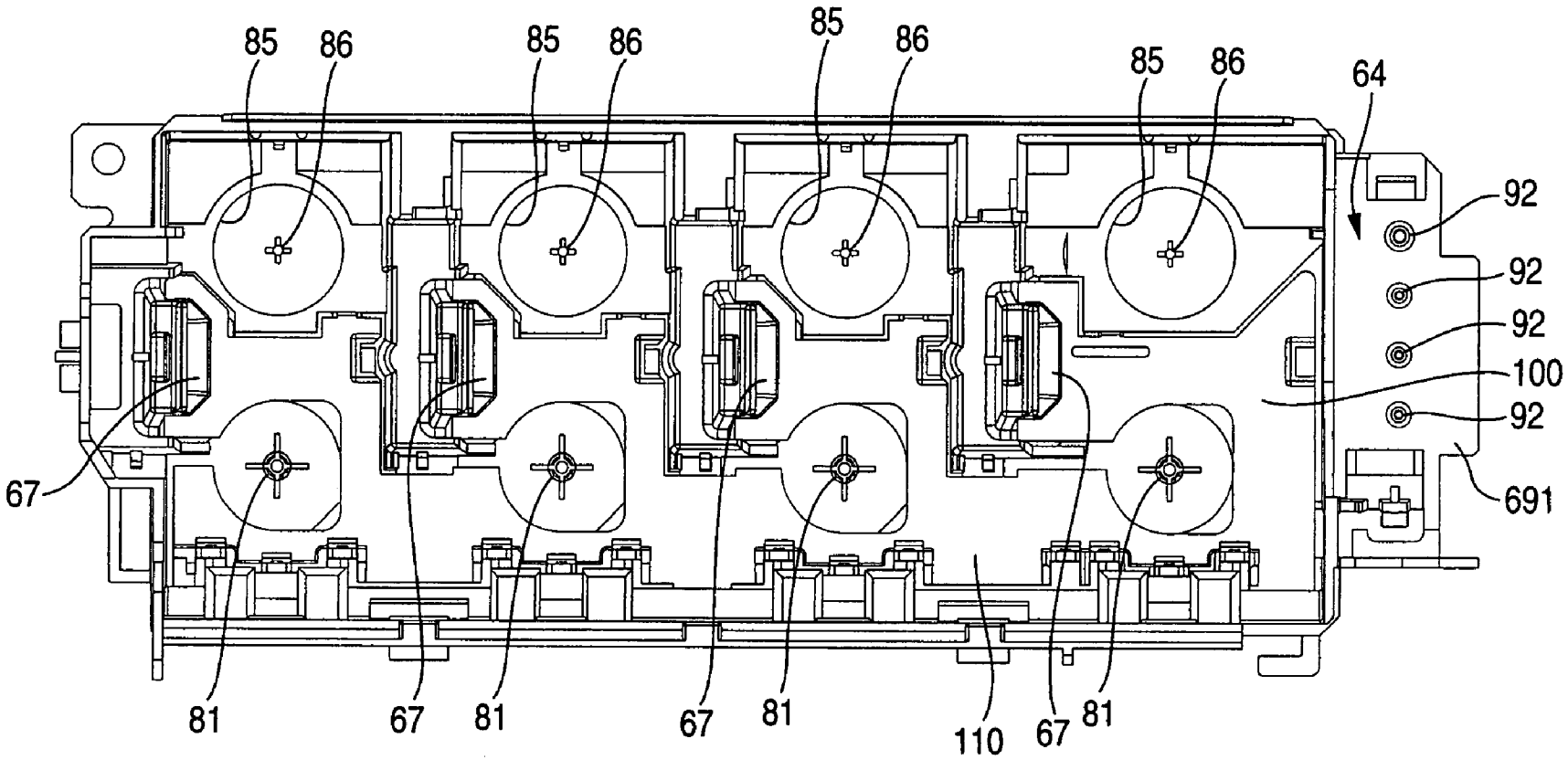
FIG. 17 is a plan view showing a holding plate attached to the holder.

Meanwhile, as shown in FIG. 17, four cylindrical tube connecting portions 92 that extend upward in the figure is disposed on the hang-over portion in parallel. One end side of the ink transporting tube S leading to the printing head 22*c* is externally fitted on the tube connecting portions 92. End portions of each of the ink grooves 83 are connected to these tube connecting portions 92.

Portions of the ink grooves 83 other than starting end side portions are constructed such that the adjacent ink grooves 83 share a part of groove wall. For example, one groove wall 84B of the ink groove 83B is connected to a groove wall 84A of the ink groove 83A in its midway portion, and then the ink groove 83B is formed between the groove wall 84B and the groove wall 84A of the ink groove 83A. Since the part of groove wall is commonly used in this manner, the width of the arrangement space of the grooves can be reduced.

Figure 14A:
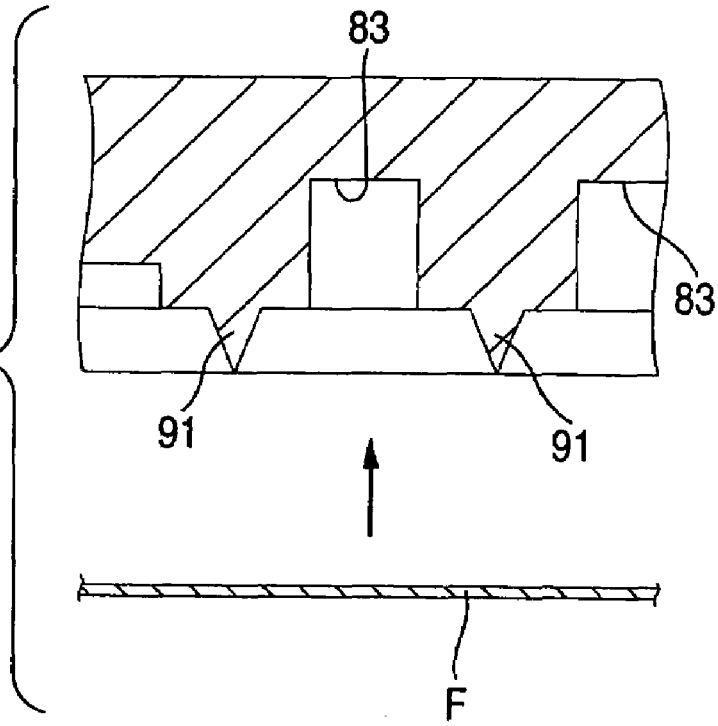
FIGS. 14A and 14B are cross sectional views showing a process of heat-welding.
Figure 14B:
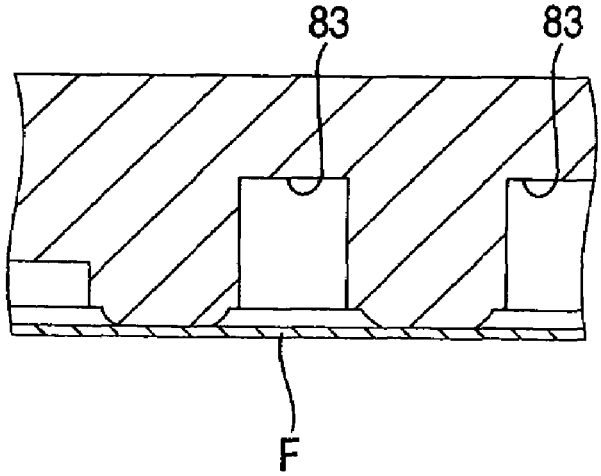
Figure 15:
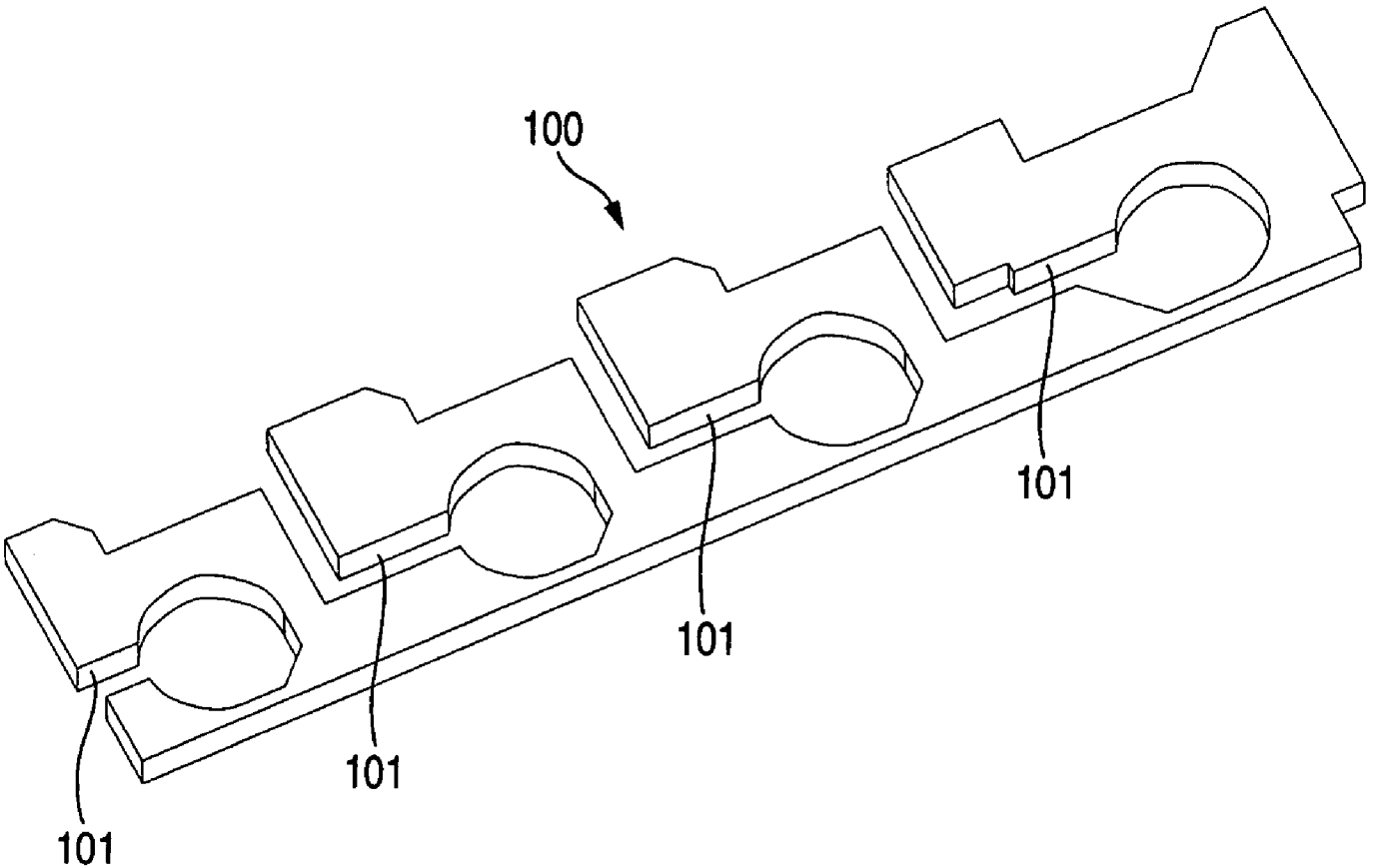
FIG. 15 is a perspective view of a foam.

Meanwhile, a plastic sheet having a high heat resistance (for example, GX film manufactured by Toppan Co., Ltd.) is heat-welded to the lower face of the holder 60. The flexible sheet (which may or may not be the GX film manufactured by Toppan Co. Ltd.) has a higher heat resistance than the base main body and the flexible sheet is heat-welded to the base main body to cover the ink flow path. More specifically, on the groove edges of the ink grooves 83 and on the periphery of the holder 60, welding ribs 91 are formed. Each of the welding ribs 91 has, as shown in FIG. 14A, a triangular sectional shape, and the tip end side thereof is made narrower than the base end side thereof. The welding ribs 91 are provided on the entire groove edges. The welding rib 91 is provided on almost the whole peripheral edge of the holder 60 except for a portion where the ink grooves 83 are formed. Thus, when heat pressing is conducted by a hot plate, etc., in a state where the plastic sheet F is superposed on the lower face of the holder 60, as shown in FIG. 14B, the welding ribs 91 melt and the plastic sheet F comes in close contact with the periphery of the holder 60. Further, the ink grooves 83 and the air grooves 93 described later are sealed without voids so that the both grooves 83, 93 are heat sealed. Incidentally, the plastic sheet F functions as the supplemental member.

By making the tip end of the welding rib 91 narrow and the base end of the welding rib 91 thick, the melt of the welding rib 91 by heating is facilitated and the welding voids are prevented from being formed. Further, since the periphery of the holder 60 is heat-welded in addition to the edges of the ink grooves 83 and the air grooves 93, even in a case where the ink is leaked when attaching or detaching the cartridge 30, the ink thus leaked does not drop through some holes that are required for injection molding and formed on the holder 60 because the whole of the lower face 71*a* is covered with the plastic sheet F. Therefore, contamination of the inside of the apparatus is prevented.

The structure in which the ink grooves 83 are covered with the plastic sheet F functions as the ink flow path, and the structure in which the air grooves are covered with the sheet functions as the air flow path.

Herein, the details of the air grooves 93 will be described with reference to FIG. 13.

In the embodiment, four air grooves 93 are arranged in a direction parallel to a direction of the arrangement of the cartridges 30. Each of the air grooves 93 is provided with an ink pooling portion 95 that is formed in a size that surrounds the circular receiving face portion 85, and a meandering portion 97 that is formed above, as shown in FIG. 13, the ink pooling portion 95. The meandering portion 97 is formed to extend near to the ink receptive portion 81 while meandering in left and right direction, and is provided with an opening 98 at a leading edge thereof, the opening 98 that communicates through the bottom wall 71 in up and down direction. The air groove 93 arranged at rightmost in FIG. 13 is configured to have a shape different from other air grooves 93 in order to form the air groove 93 away from the portion where the ink groove 83 is formed.

The welding rib 91 is formed around entire circumference of each of the ink pooling portions 95 and the meandering portions 97 along the edge of the ink pooling portions 95 and the meandering portions 97. According to this configuration, when the heat pressing is performed, the plastic sheet F is closely attached along the edge of the air grooves 93, whereby the air grooves 93 are heat-sealed. Accordingly, air is introduced into the air tower 38 through the opening 98, the air groove 93, the air inlet hole 86, and the air inlet port 39.

The meandering portion 97 is provided for allowing the air to be less flowable in the air groove 93 and for increasing the length of the passage of the air groove 93. In a case where the air groove 93 has shorter passage and configured to allow the air to be more flowable therein, the air circulation in the cartridge 30 is improved and the ink in the cartridge 30 dries faster. However, the drying of the ink in the cartridge 30 is delayed by providing the meandering portion 97. In the embodiment, a groove width of the meandering portion 97 is configured to be substantially equal to a groove width of the ink groove 83. However, regarding a groove depth, the meandering portion 97 is configured to be more shallow than the ink groove 83 in order to prevent a vaporization of the ink by reducing a movement of the air, which is a gas that has less passage friction with respect to the liquid of the ink.

The ink pooling portion 95 is configured by a concave portion of the expanding portion 75 formed in the bottom wall 71, and is configured to have a groove depth larger than the groove depth of either of the meandering portion 97 and the ink groove 83, and an inner volume (a volume of a cavity portion) larger than an inner volume of the meandering portion 97. According to this configuration, assuming that the ink in the ink room 31 flow backward into the air groove 93 through the air tower 38, the ink pooling portion 95 can reserve the ink that flow backward to the ink pooling portion 95.

Assuming that a large amount of ink flow backward, due to the configuration that the opening 98 is provided at the leading edge of the meandering portion 97, the ink overflows above the upper surface of the bottom wall 71 of the holder 60 through the meandering portion 97 and the opening 98. Accordingly, a height of the ink that flowed backward will not be higher than a position where the air inlet hole 86 is provided. Therefore, the ink reserved in the ink pooling portion 95 will not flow out from the air inlet hole 86 into the recording mechanism 20 even when the cartridge 30 is not attached, unless the recording mechanism 20 is turned over.

When a large amount of the ink is reserved in the ink pooling portion 95 as explained above, the ink flows out from the opening 98. When the out-flow of the ink from the ink pooling portion 95 is left to be continued, the cartridge 30 and the holder 60 is tainted by the ink. In order to avoid the taint by the ink, a foam 100 is provided. In the embodiment, the foam 100 is formed by a urethane member and is provided with four slits 101 formed in plate having a key-like shape and arranged to be juxtaposed with each other. The slits 101 serves as escape ports to avoid interference with the dividing wall 65 formed on the holder 60 and with the ink receptive portion 81.

Figure 18:
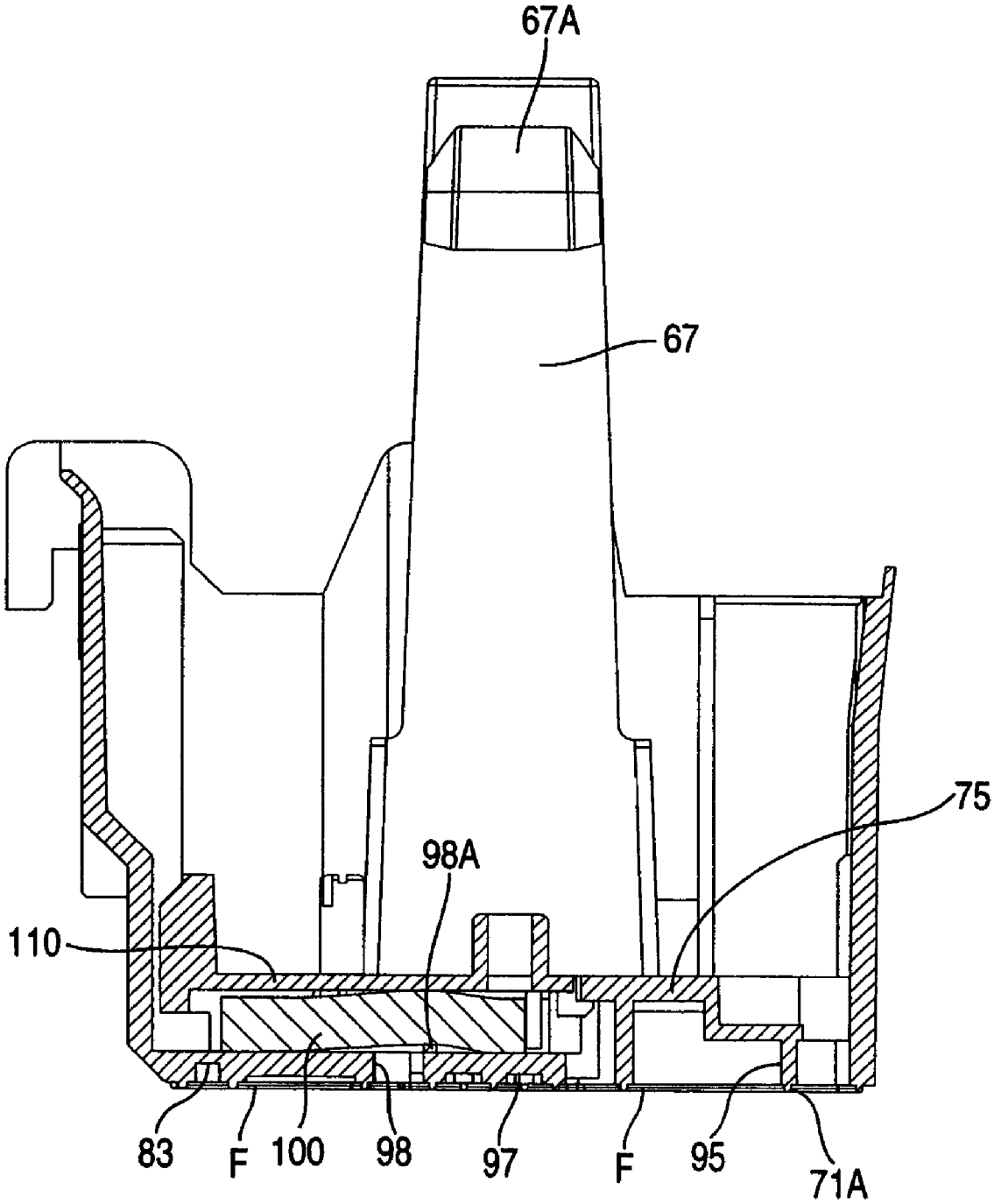
FIG. 18 is a cross sectional view showing the holding plate attached to the holder.
Figure 19:
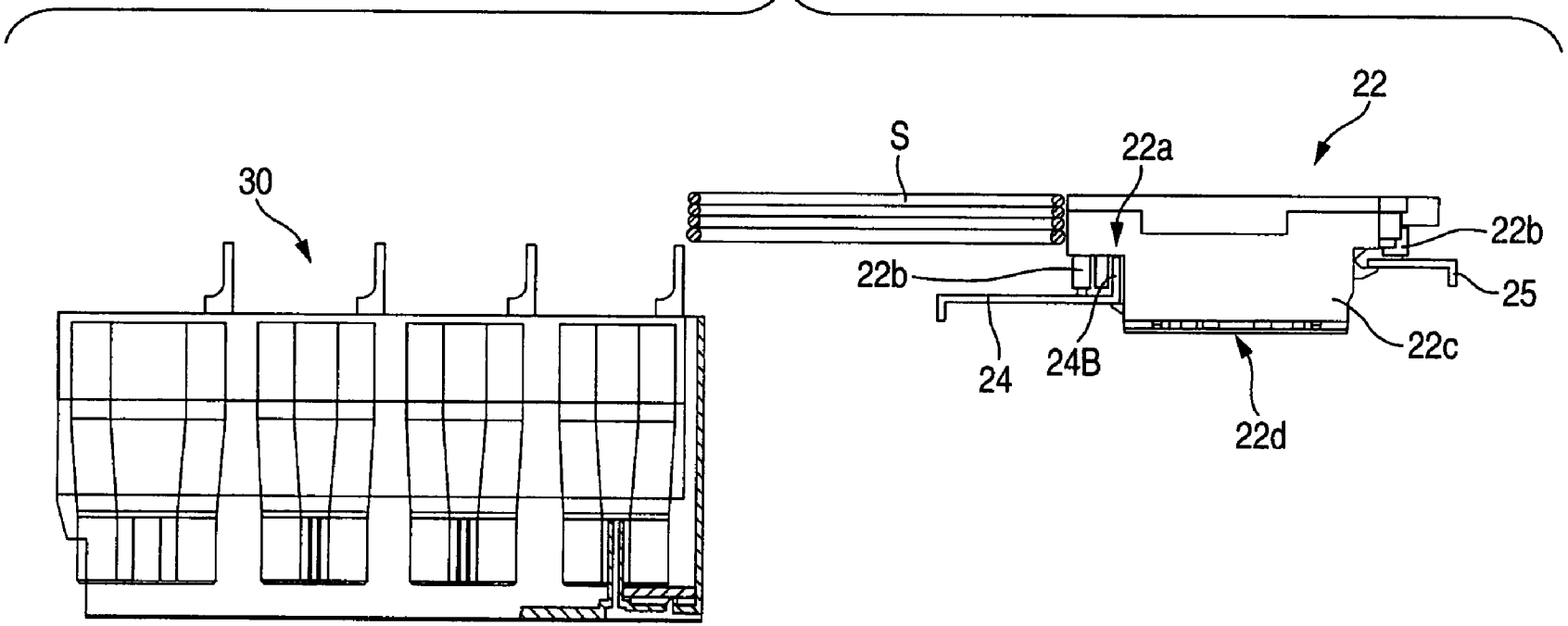
FIG. 19 is a view showing a supporting structure of the printing head and an ink supply path.

The foam 100, when attached, is configured to cover the circumference of the surface of the bottom wall 71 at the opening 98. Accordingly, when the ink flow backwards from the opening 98 to the upper surface of the bottom wall 71 (i.e. when the ink is reserved in the ink pooling portion 95 to the amount that reaches the opening 98), the foam 100 sucks the ink to avoid the inner portion of the holder 60 to be tainted. A supporting protrusion portion 98A is provided at a rim of each of the opening 98. The supporting protrusion portion 98A protrudes to the side where the foam 100 is provided and supports the foam 100 from below to retain the foam 100 in a curved state as shown in FIG. 18. According to the configuration that the foam 100 is retained in a state spaced apart from the opening 98, air permeability is assured.

Figure 11:
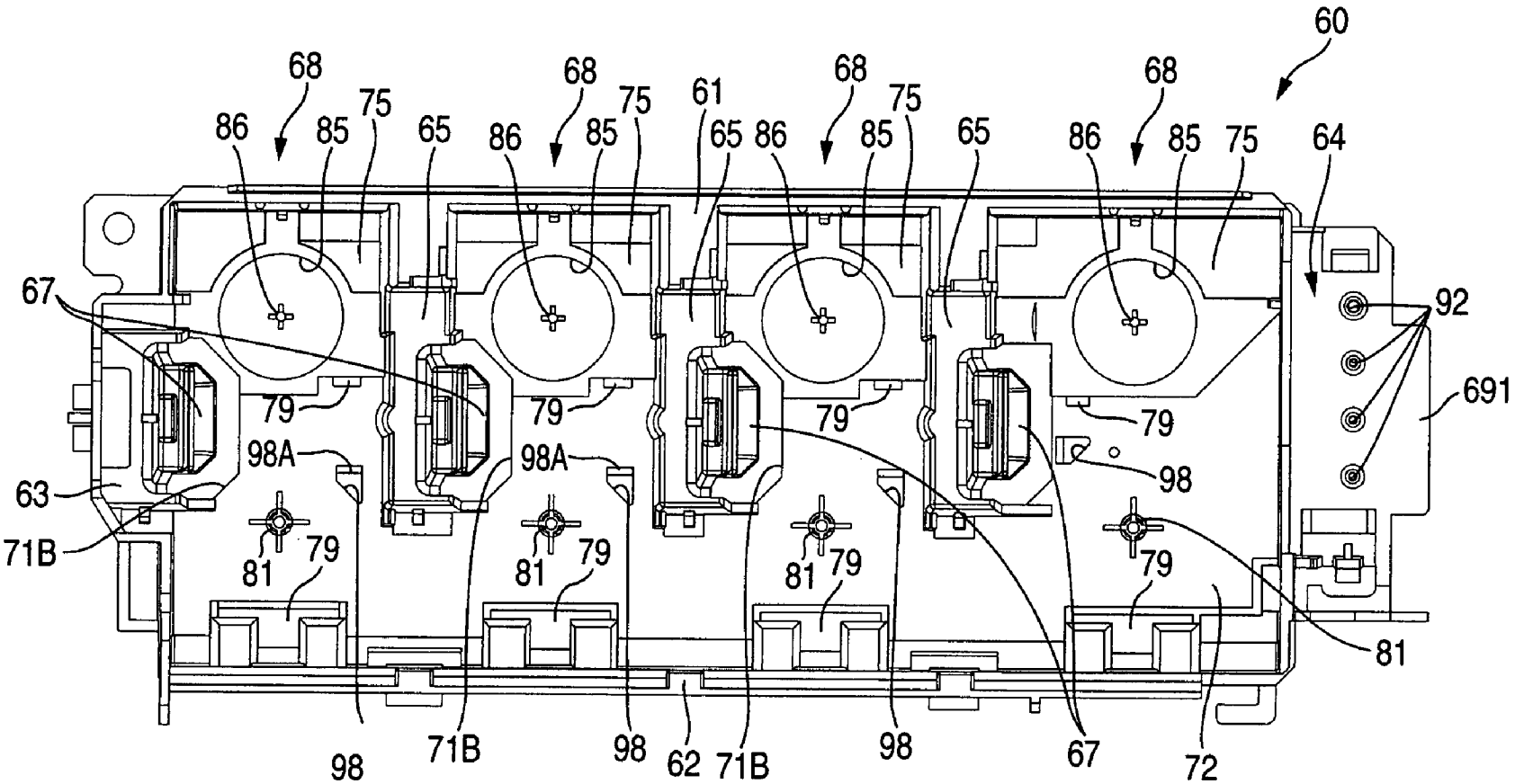
FIG. 11 is a plan view of the holder.

As shown in FIG. 11, a holding plate 110 is provided at a portion above the foam 100 to cover the foam 100. The holding plate 110 is made of resin material and formed in a shape having a size slightly larger than the foam 100. At the bottom wall 71, a supporting portion 79 for supporting the holding plate 110 is provided at a portion except where the foam 100 is provided. The holding plate 110, when attached, is supported in a state where mounted on the supporting portion 79. In this state where the holding plate 110 is attached, the upper surface of the holding plate 110 and the upper surface of the expanding portion 75 is configured to be substantially in plane with each other, as shown in FIG. 18, to thereby support the bottom surface of the cartridge 30 by both of the upper surfaces. In the attached state, the outer circumference portion of the holding plate 110 is fitted into side walls of the expanding portion 75 and the holder 60 without forming a gap, to thereby prevent the movement of the holding plate 110 in horizontal direction.

Next, an operation and an effect of the embodiment is explained in the following.

In order to replace the cartridge 30, first, the empty cartridge 30 is removed from the holder 60. For that, a latching is released by pushing the end part of the elastic locking arm 67 latched with the cartridge 30 in the lock-releasing direction. From this state, by lifting the cartridge 30 upward, the ink receptive portion 81 is retreated from the ink packing 41, and the ink cartridge 30 is removed from the holder 60.

Next, a new cartridge filled with ink is attached. For that, a bottom face of the cartridge 30 is kept directed downwardly. Further, an ink supply port 33 and an air tower 38 of the cartridge are rendered to be opposed to an ink receptive portion 81 and a circular receiving face portion 85 of the holder 60. From this state, the cartridge 30 is pushed toward the holder 60.

Then the elastic locking arm 67 is bend deformed and on the way of the pushing operation, the ink receptive portion 81 approaches into an ink outlet hole 42, and bumps into a first valve body 45, and further, a second valve body 55 bumps into a step portion part of an ink inlet hole 86. After that, the first valve body 45 and the second valve body 55 are pushed the upper direction in the figures (in the direction of release). Later on, the bottom face of the cartridge 30 bumps into an expanding portion 75 and a holding plate 110 of the holder 60, and the further operation of pushing is restricted. In this state, the elastic locking arm 67 is restored to latched with the upper face of the cartridge 30, and retains the cartridge 30, while the first valve body 45 and the second valve body 55 are in a released state.

According to the above operation, an ink path on the side of the holder 60 and an ink room 31 are connected. Then, ink runs out from the ink room 31 through an ink supply port 33, an ink groove 83, a tube connecting portion 92 and an ink transporting tube S to a printing head 22*c*. On the other hand, air paths of the air tower 38 and of the holder 60 are also connected. Then, due to the run out of ink an air pressure in the ink room 31 falls, and air is taken into the ink room 31 through an opening 98, the air path, an air inlet port 39 and the path of the air tower 38.

As such, according to the embodiment, the ink run out from the cartridge 30, is sent to the ink transporting tube S through the ink supply port 33, the ink path and the ink connecting portion 92. Thus, a drawing direction of the ink transporting tube S can be arbitrarily determined, since the ink path is configured to be intervened between the ink receptive portion 81 and the ink transporting tube S. Accordingly, the ink transporting tube S can be disposed from any position other than a rear face 71A of the bottom wall 71, and space saving becomes possible. Furthermore, a structure is simple, since the ink path is formed only by pasting (heat welding) a plastic film sheet F on the rear face 71A of the holder bottom wall 71. In addition, a thickness of the holder 60 can be thinner, and then a thickness of a whole product can be thinner, rather than forming the path by pasting plastic molding parts. Further, as a shape of a cross-section of a welding rib 91 is a tapered shape, ensuring easy melting upon welding the plastic sheet F, and a reliability of pasting becomes high.

In addition, the ink groove 83 and the air groove 93 are formed on the rear face 71A of the bottom wall 71. Then, the ink groove 83 and the air groove 93 can be sealed by one plastic sheet F in a lump. Accordingly, production efficiency is better than that when each of the ink groove 93 and the air groove 93 is sealed by a separate sheet.

OTHER ILLUSTRATIVE EMBODIMENTS

Aspects of the present invention are not limited to the illustrative embodiment explained in the above description and drawings. For example, a following illustrative embodiment is also included in the technical scope of the present invention. Furthermore, other than the following illustrative embodiment, various changes can be made without departing from the scope thereof.

(1) In another illustrative embodiment, a sheet F made of plastic is welded to an ink groove 83 and an air groove 93 to form a flow path. Something by which a flow path is configured between matching faces of overlapped members is acceptable. For example, instead of the plastic sheet F, a plate-like resin plate may be overlapped to the holder. Fixing method thereof is not limited to a heat welding. Furthermore, the groove is not necessary provided on the side of the holder 60, but the groove may be formed by straddling between members overlapped to the holder 60, or may be formed by overlapped members.

(2) In yet another illustrative embodiment, an ink receptive portion 81 is integrally formed with the holder 60, but may be separately formed.

(3) In yet a further illustrative embodiment, the holder 60 is configured by a box-type. However, the holder 60 may be configured by the bottom wall 71 if the holder is connectable to a cartridge 30.

What is claimed is:

1. An ink supply structure for supplying ink flowing out from an ink cartridge including an ink supply port via an ink transporting tube to a recording portion, comprising:

an ink cartridge base having:

a cartridge connecting portion which makes the ink flow out from the ink cartridge, when the cartridge connecting portion connects to the ink supply port upon loading of the ink cartridge on the ink cartridge base;

a tube connecting portion that connects to the ink transporting tube; and an ink flow path that connects the tube connection to the cartridge connecting portion wherein the ink cartridge base is configured by a base main body having a mating face and a supplemental member having a mating face fitted to the mating face of the base main body, the supplemental member being a flexible sheet, and wherein the ink flow path is formed between the mating faces of the base main body and the supplemental member with the tube connecting portion disposed on the base main body.

2. An ink supply structure according to claim 1, wherein the cartridge connecting portion is formed in a tubular shape to be inserted into the ink supply port, the cartridge connecting portion being integrally formed with the base main body.

3. An ink supply structure according to claim 1, wherein the tube connecting portion is formed in a tubular shape so that the ink transporting tube can be externally fitted thereto, and wherein the tube connecting portion is integrally formed with the base main body.

4. An ink supply structure according to claim 1, wherein the ink transporting tube is externally fitted to the tube connecting portion, wherein the tube connecting portion is formed in a tubular shape to protrude along a loading direction of the ink cartridge, and wherein the tube connecting portion is integrally formed with the base main body.

5. An ink supply structure according to claim 1, wherein the supplemental member is fitted to a face of the base main body opposite to the ink cartridge.

6. An ink supply structure according to claim 1, wherein an ink groove which configures the ink flow path is formed in a face of the base main body opposed to the supplemental member, and wherein the ink groove is covered by the supplemental member.

7. An ink supply structure according to claim 6, wherein the supplemental member is a plastic sheet attached to the base main body, and wherein the plastic sheet covers the ink groove.

8. An ink supply structure according to claim 7, wherein a welding rib extending along the ink groove is provided at an edge of the ink groove, and wherein the plastic sheet is heat-welded to the welding rib.

9. An ink supply structure according to claim 8, wherein a cross section of the welding rib before welding is gradually tapered from a base end of the welding rib toward a tip end of the welding rib.

10. An ink supply structure according to claim 1, wherein the base main body is provided with a side wall which surrounds a side of the ink cartridge, when the base main body is loaded with the ink cartridge.

11. An ink supply structure according to claim 1, further comprising an elastic locking arm provided on the base main body, that elastically retains the ink cartridge when the base main body is loaded with the ink cartridge.

12. An ink supply structure according to claim 1, for use with an ink cartridge having an air inlet hole for flowing air into the ink cartridge in accordance with ink flow, the air inlet hole being closed by a valve body when the ink cartridge is unloaded, wherein an air connecting portion is provided on the main base body and is arranged for connection to the air inlet hole by the valve body opened upon loading of the ink cartridge, wherein an air flow path is formed between the mating faces of the base main body and the supplemental member, wherein one end of the air flow path is connected to the air connecting portion, and wherein the other end of the air flow path is formed into an opening open to the atmosphere.

13. An ink supply structure according to claim 12, wherein an air groove which configures the air flow path is formed on a face of the base main body opposed to the supplemental member, and wherein the air groove is covered by the supplemental member.

14. An ink supply structure according to claim 12, wherein the air flow path is bent in meandering-form.

15. An ink supply structure according to claim 12, wherein an ink pooling portion is provided in the middle of the air flow path to accumulate the ink that flows backward toward the air flow path via the air inlet hole.

16. An ink supply structure according to claim 12, wherein a plate-shape porous ink-absorbing member is held along a side face of the ink cartridge base, and wherein the opening of the air flow path opens to contact with the ink absorbing member.

17. An ink supply structure according to claim 16, wherein the ink absorbing member is disposed at an ink cartridge loading side in the base main body, and wherein a holding plate is provided between the ink absorbing member and the ink cartridge.

18. An ink supply structure according to claim 12, wherein a supporting protrusion member operable to support the ink absorbing member in an unfixed-state from the opening is provided at a peripheral edge portion of the opening in the cartridge base while the supporting protrusion member protrudes toward the ink absorbing member side.

19. The ink supply structure according to claim 1, wherein the base main body has a face configured to receive the ink cartridge, and the cartridge connecting portion is located on the receiving face that is a back of the mating face of the base main body.

20. The ink supply structure according to claim 1, wherein the supplemental member being the flexible sheet has a higher heat resistance than the base main body and the flexible sheet is heat-welded to the base main body to cover the ink flow path.

21. A multi function device comprising:

at least one scanner;

at least one phone;

a printer including:

a recording portion;

an ink cartridge storing ink and having an ink supply port;

an ink transporting tube through which the ink flows out from the ink supply port of the ink cartridge to be supplied to the recording portion; and, an ink cartridge base having:

a cartridge connecting portion which makes the ink flow out from the ink cartridge, when the cartridge connecting portion connects to the ink supply port upon loading of the ink cartridge on the ink cartridge base;

a tube connecting portion for connection to the ink transporting tube;

an ink flow path which connects the tube connecting portion to the cartridge connecting portion, wherein the ink cartridge base is configured by a base main body having a mating face and a supplemental member having a mating face fitted to the mating face of the base main body the supplemental member being a flexible sheet, and wherein the ink flow path is formed between the mating faces of the base main body and the supplemental member with the tube portion disposed on the base main body.

22. A printer comprising:

a recording portion;

an ink cartridge storing ink and having an ink supply port;

an ink transporting tube through which the ink flows out from the ink supply port of the ink cartridge to be supplied to the recording portion; and an ink cartridge base having:

a cartridge connecting portion which makes the ink flow out from the ink cartridge, when the cartridge connecting portion connects to the ink supply port upon loading of the ink cartridge on the ink cartridge base;

a tube connecting portion that connects the tub connecting portion to the ink transporting tube; and an ink flow path which connects to the cartridge connecting portion, wherein the ink cartridge base is configured by a base main body having a mating face and a supplemental member having a mating face fitted to the mating face of the base main body, the supplemental member being a flexible sheet, and wherein the ink flow path is formed between the mating faces of the base main body and the supplemental member with the tube connecting portion disposed on the base main body.

23. An ink supply structure for use with an ink cartridge having an ink supply port for flowing ink out of the ink cartridge and an air inlet for flowing air into the ink cartridge in accordance with ink flow, the ink supply structure comprising:

a base including:

a cartridge connecting portion configured to connect to the ink supply port of the ink cartridge;

an air connecting portion configured to connect to the air inlet of the ink cartridge; and a tube connecting portion configured to connect to an ink tube that extends to a recording portion; and a sheet member attached to the base, wherein an ink flow path that connects the tube connecting portion to the cartridge connecting portion, and an air flow path that connects the air connecting portion to the atmosphere are defined between the base and the sheet member.

24. The ink supply structure according to claim 23, wherein an ink groove that configures the ink flow path and an air groove that configures the air flow path are formed in a first face of the base, wherein the sheet member is a flexible film, and wherein the flexible film is attached to the first face of the base to cover the ink groove and the air groove.

25. The ink supply structure according to client 24, wherein the cartridge connecting portion, the air connecting position, and the tube connecting portion are formed on a second face of the main body, the second face being a back of the first face.

* * * * *